US006642819B1

(12) United States Patent
Jain et al.

(10) Patent No.: US 6,642,819 B1
(45) Date of Patent: Nov. 4, 2003

(54) METHOD AND BEND STRUCTURE FOR REDUCING TRANSMISSION LINE BEND LOSS

(75) Inventors: Nitin Jain, San Diego, CA (US); Nenad Djapic, San Diego, CA (US)

(73) Assignee: Anokiwave, Inc., San Diego, CA (US)

( * ) Notice: Subject to any disclaimer, the term of this patent is extended or adjusted under 35 U.S.C. 154(b) by 87 days.

(21) Appl. No.: 10/081,477

(22) Filed: Feb. 21, 2002

Related U.S. Application Data

(60) Provisional application No. 60/338,460, filed on Nov. 30, 2001.

(51) Int. Cl.[7] ..... H01P 3/08

(52) U.S. Cl. ..... 333/246; 333/33; 333/128; 333/35

(58) Field of Search ..... 333/246, 245, 333/244, 33, 34, 156, 125, 35, 263, 128, 115

(56) References Cited

U.S. PATENT DOCUMENTS 3,815,055 A * 6/1974 Plunk et al. ..... 333/128
4,704,590 A * 11/1987 Schneider ..... 333/115
6,538,528 B2 * 3/2003 Louzir et al. ..... 333/128

* cited by examiner

*Primary Examiner*—Robert Pascal
*Assistant Examiner*—Dean Takaoka
(74) *Attorney, Agent, or Firm*—Loyal McKinley Hanson

(57) ABSTRACT

A dielectric transmission line bend structure includes an electrically conductive strip that forms a bend (e.g., a right angle bend). The inner edge of the bend includes a plurality of curved and/or straight line segments that result in the inner edge extending along a circuitous path in order to thereby reduce transmission line loss. A T-type junction includes a first or left side inner edge bending to the left and a second or right side inner edge bending to the right, with both inner edges including segments that result in greater inner edge lengths in order to increase current path lengths along the inner edges and thereby help reduce transmission line loss. A method of designing a transmission line bend structure includes the step of providing a preliminary bend structure design having an electrically conductive strip with at least one inner edge extending along a circuitous path between first and second inner edge end points on the strip. The method proceeds by producing simulation information indicative of transmission line loss characteristics of the preliminary bend structure design, and adjusting the length of the circuitous path according to the simulation information in order to produce an final design having improved transmission line loss characteristics.

12 Claims, 19 Drawing Sheets

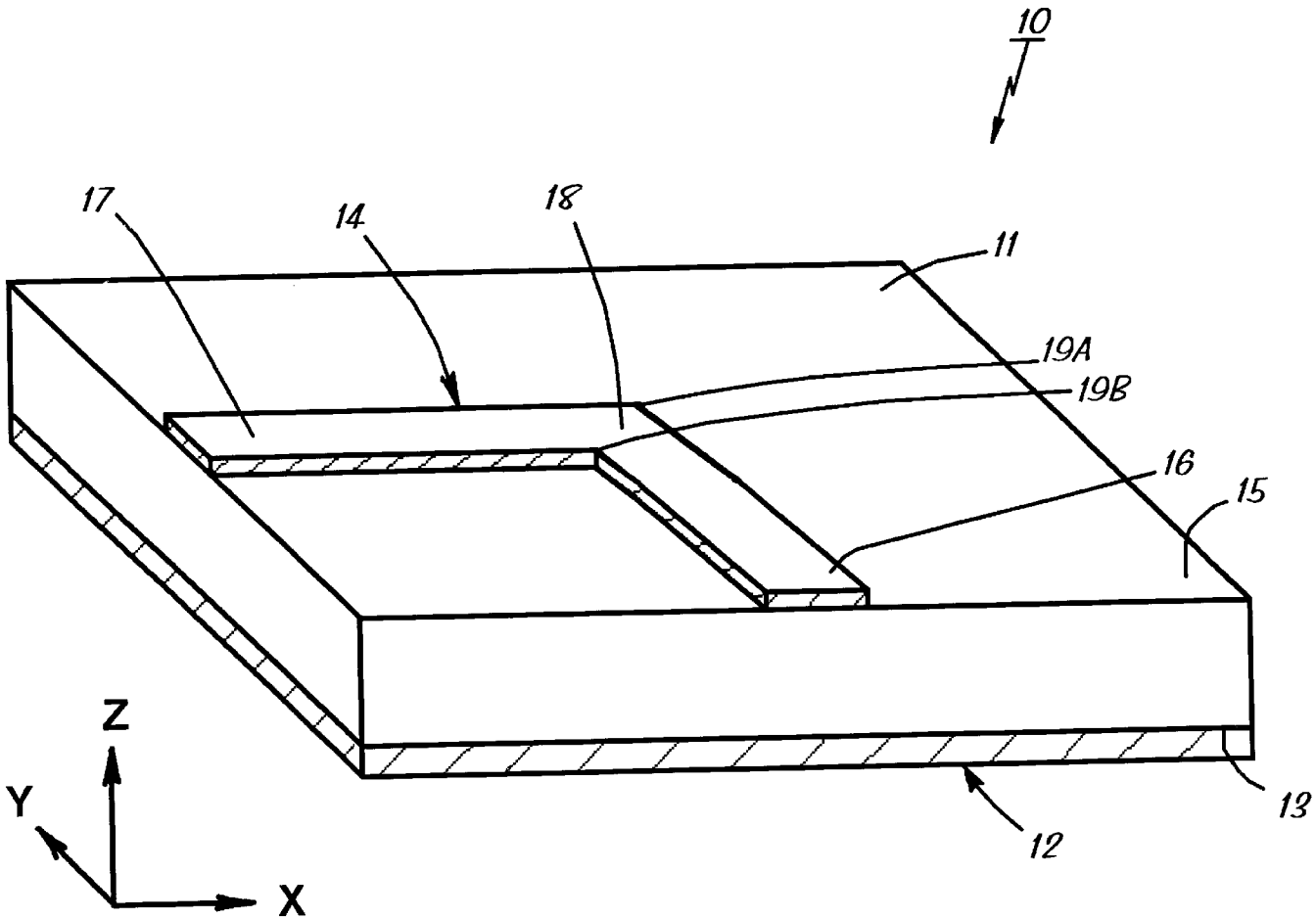
Fig. 1a - Prior Art

METHOD AND BEND STRUCTURE FOR REDUCING TRANSMISSION LINE BEND LOSS

CROSS REFERENCE TO RELATED APPLICATION

This application claims the benefit of copending U.S. Provisional Application Ser. No. 60/338,460 filed Nov. 30, 2001.

BACKGROUND OF THE INVENTION

1. Technical Field

This invention relates generally to microwave and millimeter-wave (mm-wave) radio frequency (RF) circuits, and more particularly to transmission line bends for such circuits and the losses they introduce.

2. Description of Related Art

Some mm-wave and microwave RF circuits are integrated on a single dielectric substrate with transmission lines that feed RF between the circuits. Such a transmission line may take the form of a microstrip transmission line, for example, that includes an electrically conductive pattern (a ground plane) on one side of the substrate and a parallel electrically conductive second pattern (a microstrip) on the opposite side of the substrate. RF energy coupled to the transmission line results in an electromagnetic (EM) field between the conductive strip and the ground plane that propagates RF energy along the transmission line within the substrate.

Such transmission lines often include bends that turn the direction of energy propagation (i.e., change the direction of field orientation) from one direction to another. A right angle bend, for example, turns the direction of energy propagation 90-degrees. The problem is that such transmission line bends introduce losses.

One type of loss, called the return loss, relates to the energy being reflected back from the bend. It is represented by the scattering parameter $S_{11}$ and it is affected by various attributes of the transmission line bend. Capacitance arises through charge accumulation at the corners of a bend, particularly, around the outer point of the bend where electric fields concentrate. Inductance arises also because of current flow constriction. In addition, the change of field orientation at a right angle bend is influenced by mode conversions. These influences significantly increase the return loss.

Focusing on the return loss, several techniques have been investigated in the past for the compensation of microstrip bends in order to reduce the effect of the capacitance and inductance. Doing so improves the voltage standing wave ratio (VSWR) and reduces the return loss. Bends have been mitered and rounded to reduce return loss. In addition, the miter technique removes metal where there is no current flow, and that reduces capacitance and thereby the return loss.

Although the foregoing techniques are helpful in reducing return loss introduced by the transmission line bends, they do not reduce a second type of loss in the insertion loss, namely the losses due to free space radiation and losses due to substrate leakage. The right angle bend is recognized as one of the largest contributors of radiation loss, and detailed analysis of bends and analytical expressions for calculating power loss in right angle bends are available in the literature. However, existing techniques fail to reduce radiation loss adequately for many applications, and so a need exists for a method and bend structure for reducing transmission line bend loss that reduces radiation loss also.

SUMMARY OF THE INVENTION

In line with the foregoing, it is an object of this invention to provide a method and bend structure for reducing transmission line bend loss. This object is achieved by providing a bend structure having an electrically conductive strip that forms a bend with at least one inner edge. The inner edge is segmented into multiple non-aligned segments so that its length is increased. Doing so increases the length of the current paths along the inner edge and that helps reduce radiation loss. Stated another way, the invention reduces insertion loss by reducing the phase difference built up in the current and by balancing the fringing field. That also reduces the ground current spreading, thereby reducing the overall radiation.

To paraphrase some of the more precise language appearing in the claims, a transmission line bend structure constructed according to the invention includes a substrate and an electrically conductive pattern on the substrate that forms a transmission line. The electrically conductive pattern includes at least one strip that forms a bend from a first direction to a second direction different from the first direction. The bend includes at least one inner edge and an oppositely disposed outer edge. The inner edge has been modified to include a plurality of segments (curved or straight) so that the inner edge is physically at least as long as the outer edge in order to better match electrical length and thereby reduce transmission line loss.

The technique works as well for T-type junctions. The T-type junction includes oppositely disposed first and second inner edges, the first inner edge extending between first and second end points of the first inner edge, and the second inner edge extending between first and second end points of the second inner edge. The first inner edge includes a first plurality of non-aligned segments that result in the first inner edge having a length greater than a straight line segment between the first and second end points of the first inner edge, and the second inner edge includes a second plurality of non-aligned segments that result in the second inner edge having a length greater than a straight line segment between the first and second end points of the second inner edge. That increases current path lengths along the first and second inner edges in order to help reduce transmission line loss.

In line with the foregoing, a method of designing a transmission line bend structure according to the invention includes the step of providing a preliminary bend structure design having an electrically conductive pattern that includes a strip with at least one inner edge extending along a circuitous path between first and second inner edge end points on the strip. The method proceeds by producing a computer simulation or measurements of the preliminary bend structure design that provides simulation information indicative of transmission line loss characteristics of the preliminary bend structure design. Then, the designer adjusts the circuitous path according to the simulation information to produce an improved bend structure design with reduced transmission line loss.

Thus, the invention may be said to adjust current phase in order to avoid current dipoles in the strip that would otherwise contribute to radiation loss. The energy savings realized is very important at high frequencies and occurs with no detrimental effects in performance. In addition, with radiation loss substantially reduced, antenna patterns from multipatch antennae can be improved. This allows better prediction of losses and radiation patterns for multi-element printed arrays. The following illustrative drawings and detailed description make the foregoing and other objects, features, and advantages of the invention more apparent.

BRIEF DESCRIPTION OF THE DRAWINGS

FIG. 1*a* of the drawings is an isometric view of a simple, prior art, right angle bend (not to scale);

DESCRIPTION OF THE PREFERRED EMBODIMENTS

Figure 1B:
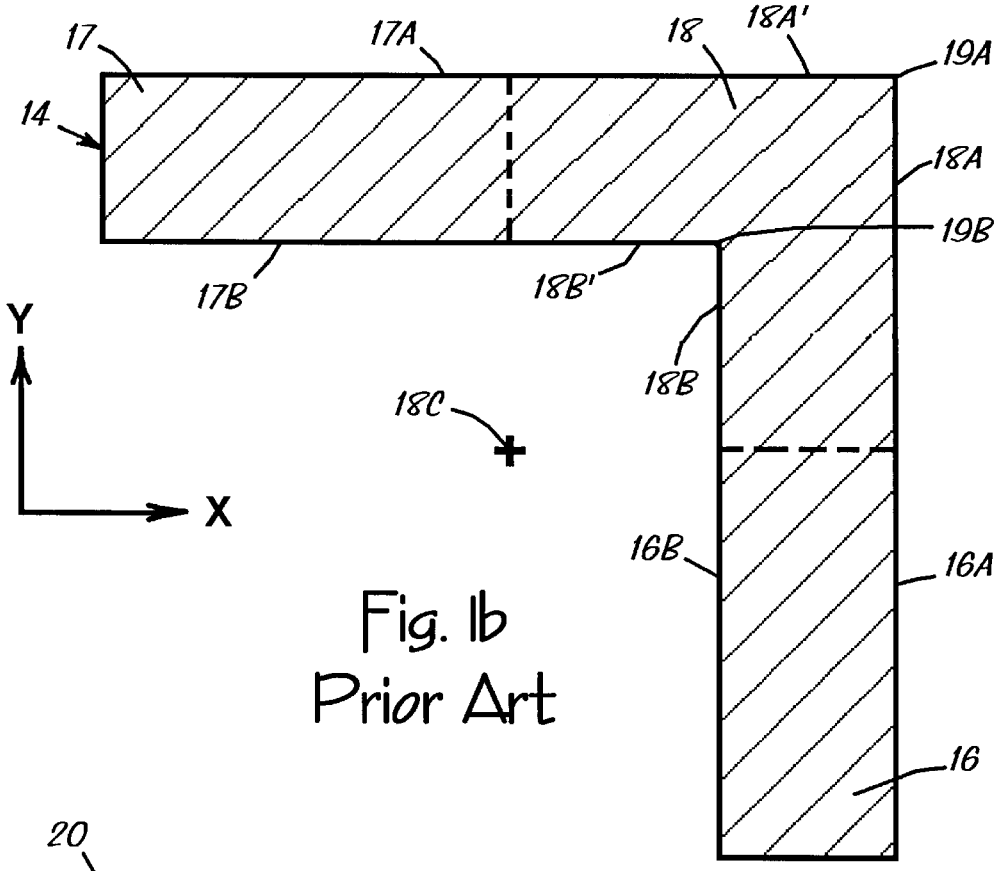
Fig. 1b Prior Art
FIG. 1*b* is an enlarged plan view of just the electrically conductive pattern of the prior art right angle bend.

This description begins by considering some prior art transmission line bend structures in order to help develop the problems involved and the nomenclature used in the description and the claims. Then, various embodiments constructed according to the invention are considered. First, refer to FIGS. 1*a* and 1*b*. They show various aspects of a right angle transmission line bend structure 10 constructed according to the prior art. Generally, the bend structure 10 (FIG. 1*a*) includes a dielectric substrate 11, an electrically conductive first pattern 12 on a first side 13 of the substrate 11 that forms a ground plane, and an electrically conductive second pattern 14 on a second side 15 of the substrate 11 that forms a transmission line strip or microstrip. Together, those elements form a microstrip transmission line. The substrate 11 may, for example, take the form of a substrate composed of the material available under the trademark RO3003 HIGH FREQUENCY CIRCUIT MATERIAL from Rogers Corporation of Chandler, Ariz., the electrically conductive patterns 12 and 14 may be composed of copper, and the bend is used to re-orient the flow of RF energy from one direction to another.

The particulars of bend structure geometry significantly affect transmission line loss. First, consider the second pattern 14. It includes a first section 16, a second section 17, and a third section 18 between the first and second sections 16 and 17. The first section 16 extends in the Y direction of the X-Y-Z Cartesian coordinate system identified in FIGS. 1*a* and 1*b* (a first bend direction), and the second section 17 extends in the negative X direction (a second bend direction). The third section 18 extends between the first and second sections 16 and 17 and it forms a right angle bend having an outer vertex 19A and an inner vertex 19B. Dashed lines in FIG. 1*b* extending perpendicular to respective ones of the X and Y axes serve to identify the extent of the of the third section 18.

The first, second, and third sections 16, 17, and 18 of the second pattern 14 provide a signal path, while the first pattern 12 (the ground plane) provides a return path. Current flows through the first section 16 in the Y direction to the third section 18 were it turns into the negative X direction and continues in the second section 17, while the return current flows in the return path provided by the first pattern 12 (the ground plane) in the opposite direction. Although the bend structure 10 is described in terms of a microstrip transmission line, the principles involved apply to other forms of transmission lines, including strip line, coplanar waveguide, balanced line, and so forth. As used herein, the term "transmission line" includes such other alternatives.

Figure 1C:
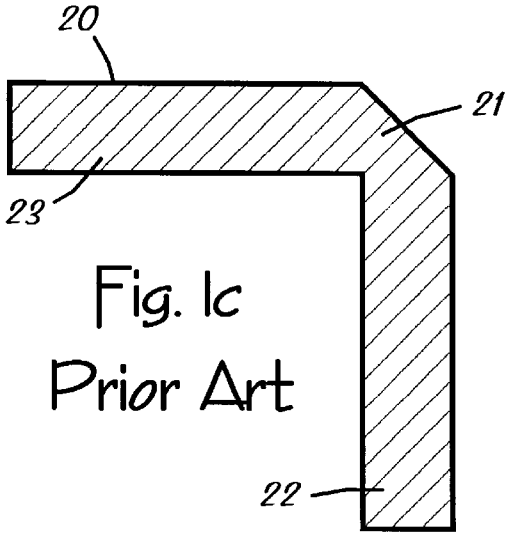
Fig. 1c Prior Art
FIG. 1*c* is a plan view of a prior art mitered bend.
Figure 1D:
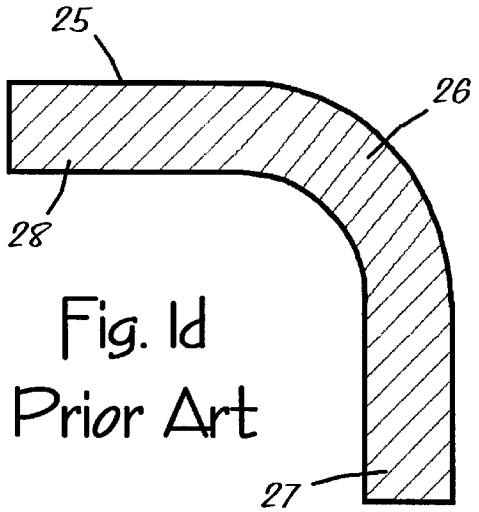
Fig. 1d Prior Art
FIG. 1*d* is a plan view of a prior art circular bend.

The bend shown in FIGS. 1*a* and 1*b* has extra-capacitance which introduces a significant return loss. Past work and practice prescribe the use of a miter to reduce the extra capacitance and thereby reduce the return loss. FIG. 1*c* shows a right angle bend pattern 20 that has a third section 21 between first and second sections 22 and 23. The corner has been cut off (forty-five degree miter) so that the capacitance is reduced, thereby providing better return loss characteristics. FIG. 1*d* shows a circular right angle bend pattern 25 (also referred as round or curved bend) having a third section 26 between first and second sections 27 and 28. The bend pattern is curved to help reduce return loss.

Figure 2:
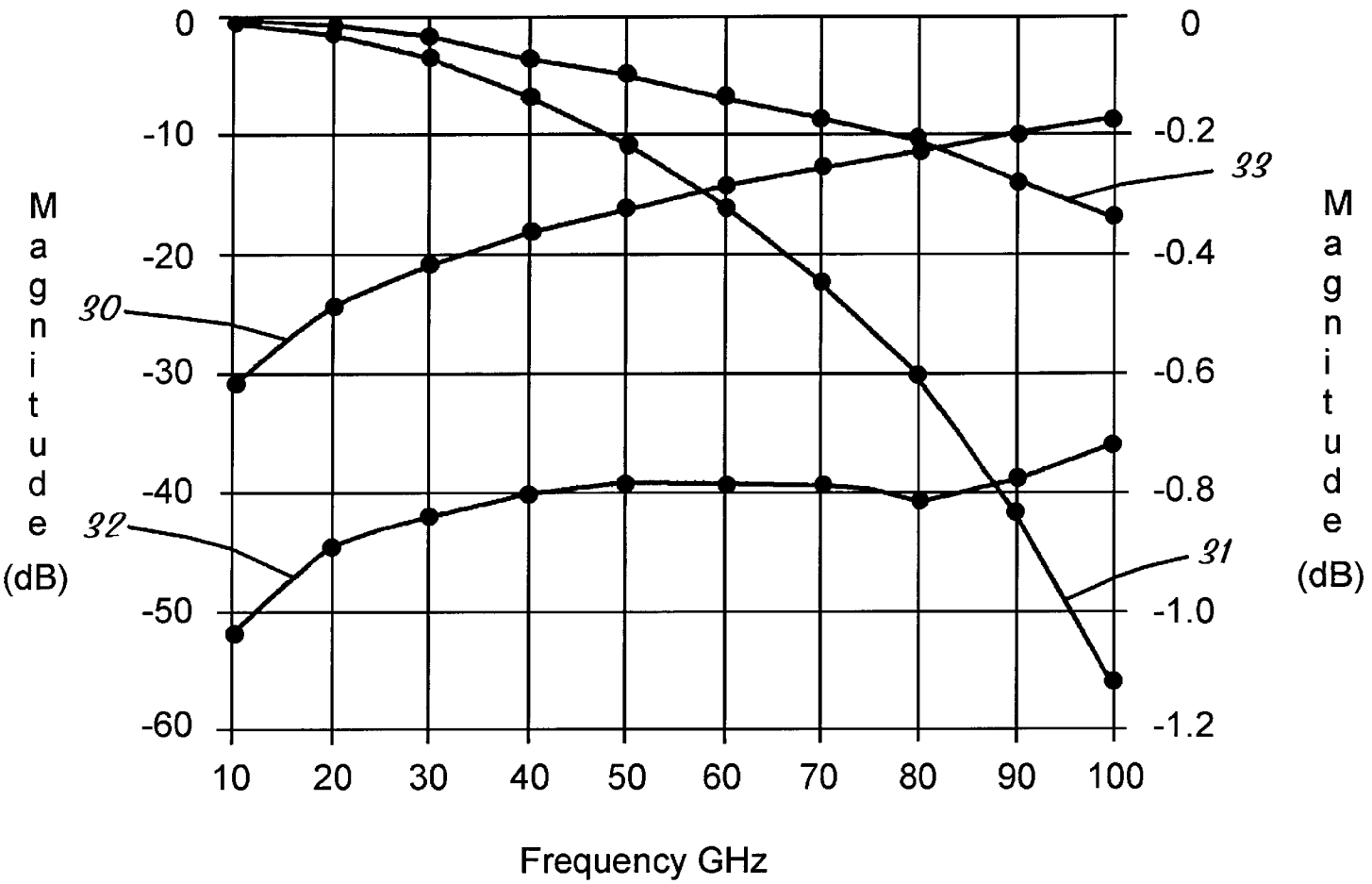
FIG. 2 includes plots of the return loss and insertion loss simulated by EM simulation software for the right angle bends in FIGS. 1*b* and 1*c;*
Figure 3A:
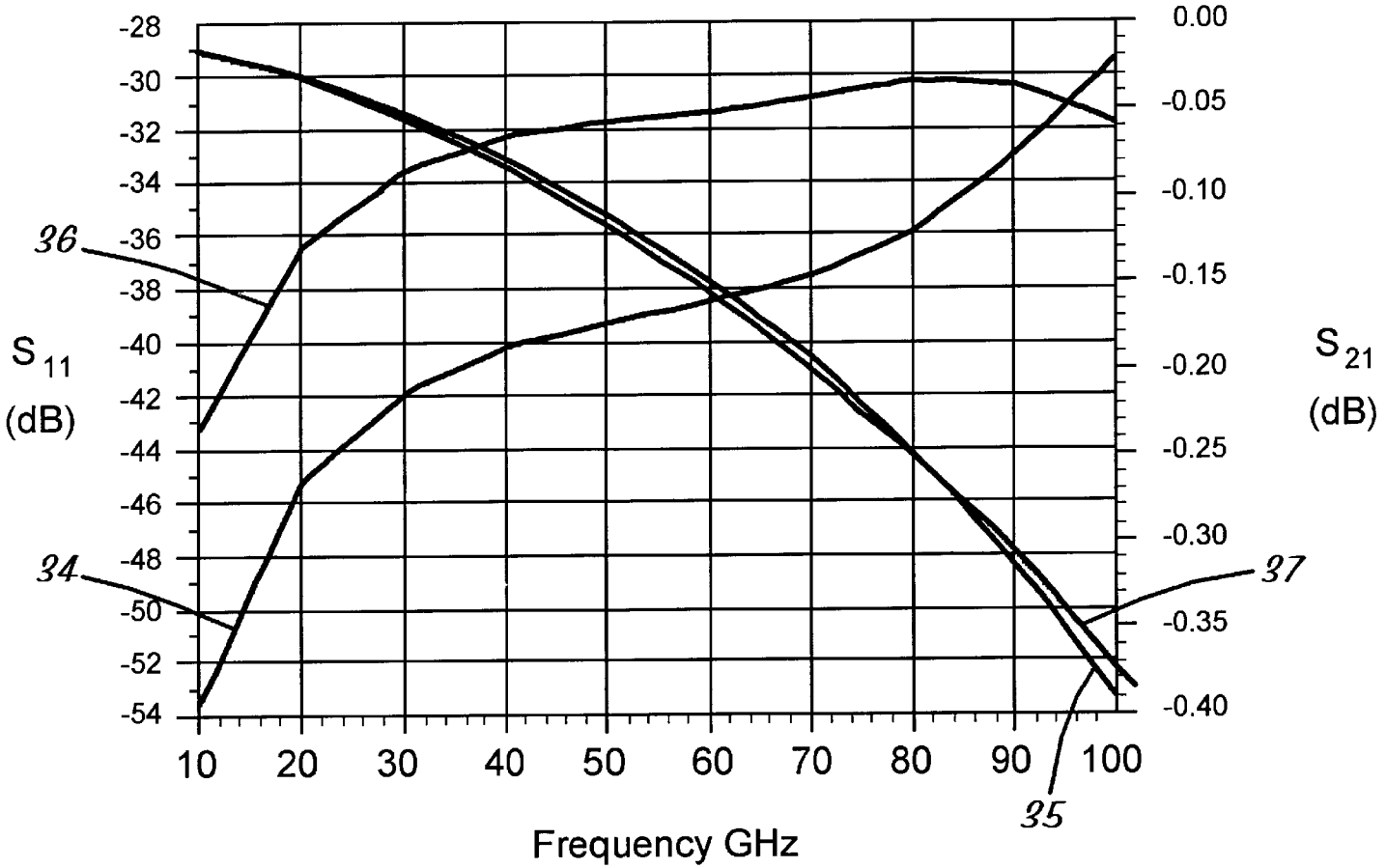
FIG. 3*a* shows simulated performance of the miter bend in FIG. 1*c* and the circular bend in FIG. 1*d;*

Using the de-embedding and reference line shift procedure in which the losses in the ports and line lengths are removed, accurate comparison between the bends 18, 20 and 25 can be made as shown in FIGS. 2 and 3*a*. That way the bend itself is analyzed for loss. Since making measurements at mm-wave frequencies is a difficult and lengthy process, accurate losses due to the bends 10, 20, and 25 are studied in EM simulations using commercial software such as that available under the trademark SONNET from Sonnet Software, Inc. of Liverpool, N.Y. (http://www.sonnetusa.com) and that available under the trademark MOMENTUM from Agilent Technologies of Palo Alto, Calif. (http://www.agilent.com).

FIG. 2 shows return loss and insertion loss characteristics for the de-embedded structures from FIGS. 1*a*–1*c*, as represented by scattering parameters $S_{11}$ and $S_{21}$. FIG. 2 includes four plots. Plots 30 and 31 are, respectively, the return loss $S_{11}$ and the insertion loss $S_{21}$ for the bend structure 10 in FIGS. 1*a* and 1*b*, while plots 32 and 33 are, respectively, the return loss $S_{11}$ and the insertion loss $S_{21}$ for the bend structure 20 in FIG. 1*c*. The left scale is for the return loss plots 30 and 32, while the right scale is for the insertion loss plots 31 and 33. Notice that the insertion loss difference at 80 GHz is more than 60%. The 60% difference in insertion loss is a very significant improvement and that is the reason why the miter structure is currently employed in many designs.

FIG. 3*a* compares characteristics of the mitered bend 20 and the circular bend 25 using the MOMENTUM simulation software. Plots 34 and 35 are, respectively, the return loss $S_{11}$ and the insertion loss $S_{21}$ for the bend 25, while plots 36 and 37 are, respectively, the return loss $S_{11}$ and the insertion loss $S_{21}$ for the mitered bend 20. The left scale is for the return loss plots 34 and 36, while the right scale is for the insertion loss plots 35 and 37. These plots show that the circular bend 25 and the mitered bend 20 have about the same amount of insertion loss, and that the return loss is better than 25 dB for both of the structures for frequency up to 100 GHz.

From the foregoing, we see that the prior art smooths the bend somewhat from one direction to the other in order to reduce return loss. But return loss is only one problem. Insertion loss is also a problem. Recall that at high frequencies, the current in printed transmission line on printed circuit board (PCB) is heavily concentrated along the edges of the strip line. Since most of the current flows along the edges of the microstrip, it must flow a longer distance along outer edges 18A and 18A' (through the outer vertex 19A in FIG. 1*b*) than it does along inner edges 18B and 18B' (through the inner vertex 19B in FIG. 1*b*).

The inner edge and outer edge nomenclature reflects the fact that the inner edge (the combination of inner edge portions 18B and 18B') is disposed inwardly toward a reference point 18C about which the third section 18 changes direction from the Y direction to the negative X direction (FIG. 1*b*), while the outer edge (the combination of outer edge portions 18A and 18A') is disposed outwardly away from the reference point 18C. In other words, the inner edge portions 18A and 18A' are disposed toward the direction of the bend. Thus, the inner edge portions 18B and 18B' present a shorter current path than do the outer edge portions 18A and 18A'. Therefore, the current has a longer path through the outer edge portions 18A and 18A' so that there is an imbalance (i.e., a phase difference) resulting from a current path length difference between the inner and outer edges. This is also true for the current paths for the mitered and circular bends 20 and 25 shown in FIGS. 1*c* and 1*d*. As a result, asymmetric fringing fields form and the bend radiates power into space. In an equivalent electrical sense, the vertex 19A has fields that radiate away from the line. These stray fields radiate power into space. Alternatively, the current non-symmetry in the line and ground path may be thought of as causing radiation.

Figure 3B:
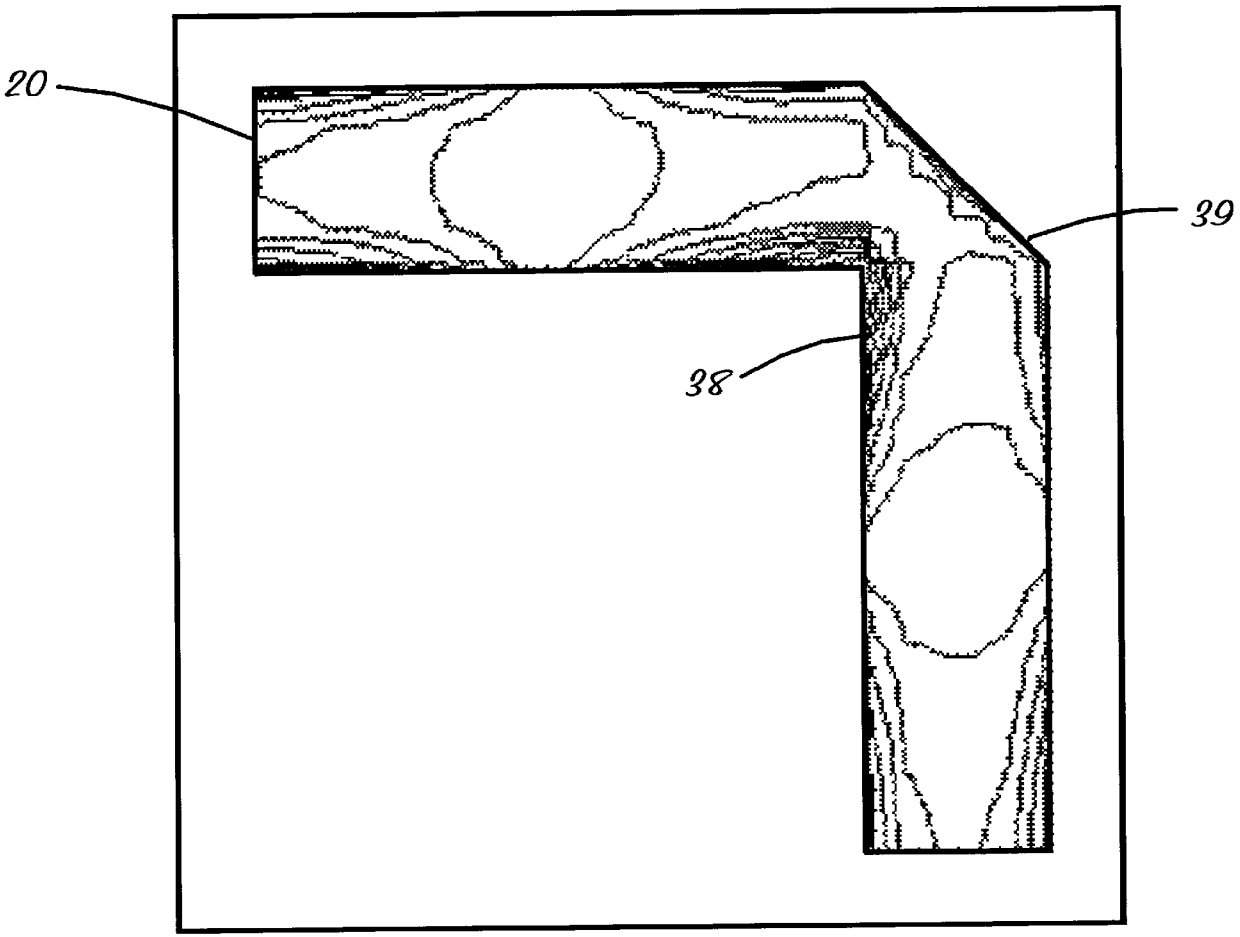
FIG. 3*b* is a contour plot of current flow density in the miter bend in FIG. 1*c;*

For the bend structures 14, 20, and 25, there is a significant path difference between the inner and outer edges that results in radiation. In addition, the ground paths are not able to follow the current in the signal path and that contributes further to the overall imbalance and resulting radiation. FIG. 3*b* shows the contour of current density for the mitered bend 20 at 80 GHz. The contour lines show that the geometry is on the order of a quarter wavelength and thus the phase difference between current flowing along the inner edge 38 and current flowing along the outer edge 39 can be significant and form a current dipole that causes radiation. Notice that the current densities along the edges 38 and 39 close to the vertices are greater along the inner edge 38 than along the outer edge 39. This difference in current densities causes asymmetric fringing fields that cause additional radiation losses in the bend 20.

The literature recognizes the right angle bend as being one of the largest contributors of radiation loss. It contains detailed analysis of bends and provides analytical expressions for calculating power loss in right angle bends. The radiation pattern is similar to that of Hertzian magnetic dipole. The fields can be found by integrating phase and distance factors in calculating strip and polarization currents. For a right angle bend, the radiating power can be expressed as $$P_{rad}=60(k_0h)^2F(\epsilon_{eff}) \qquad \text{Equation 1}$$

where, $P_{rad}$ is the radiated power $k_0$ is the free space wave number h is the substrate thickness $\epsilon_{eff}$ is the effective dielectric constant $F(\epsilon_{eff})$ is the form factor, a function of $\epsilon_{eff}$.

For large permittivity, the form factor holds the value of $$F(\varepsilon_{eff}) = \frac{4}{3\varepsilon_{eff}} \qquad \text{Equation 2}$$

The power loss is referenced to a current of 1.0 Ampere flowing through a 50-Ohm microstrip line (i.e., 50 Watts of power). If the same current flows through the microstrip right angle bend of the same characteristic impedance, the loss due to radiation can be expressed as $$IL = 10\log_{10}\left(\frac{50 - P_{\text{rad}}}{50}\right) \qquad \text{Equation 3}$$

Loss due to radiation depends on the shape of the bend structure. If the current paths along the inner and outer edges of the bend are the same, the current is better balanced (in phase) and the power radiated is reduced. In other words, the radiated power is reduced if the current phases are equal. Similarly, if the ground currents were to follow the current in the second pattern 14 (i.e., the microstrip current), the radiated power from the second pattern 14 would cancel that from the ground. However, the ground current fails to follow the strip current at the bend. The form-factor of the second pattern 14 forces the current to turn. The ground current, on the other hand, is not constrained by the shape of the second pattern 14 (i.e., the printed trace) and may diverge from the signal path spatially. In addition, the bend in FIGS. 1*a* and 1*b* has a sharp corner and it radiates. Since there is not a balancing sharp corner opposite 19A, additional radiation loss occurs.

Figure 4A:
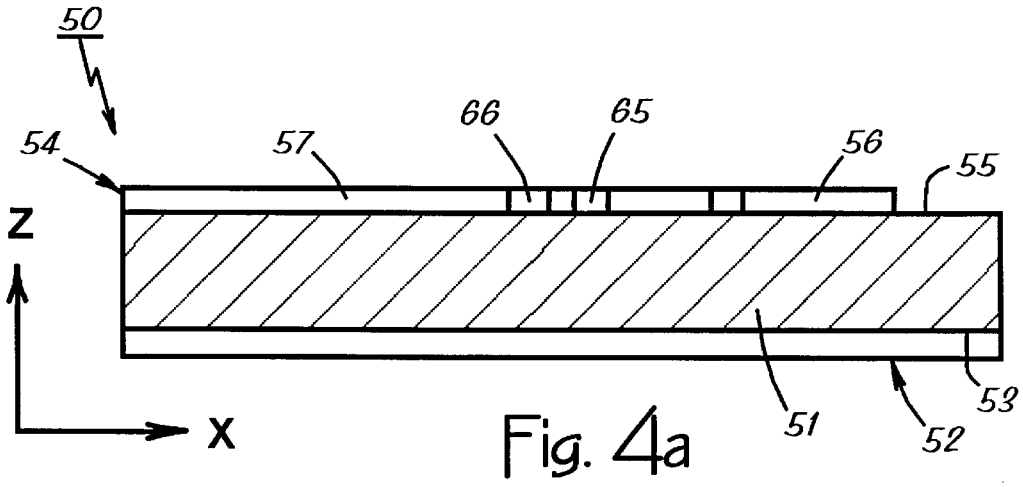
FIG. 4*a* is an elevation view of a current-phase-adjusted, mitered, right angle transmission line bend constructed according to the present invention (not to scale)
Figure 4B:
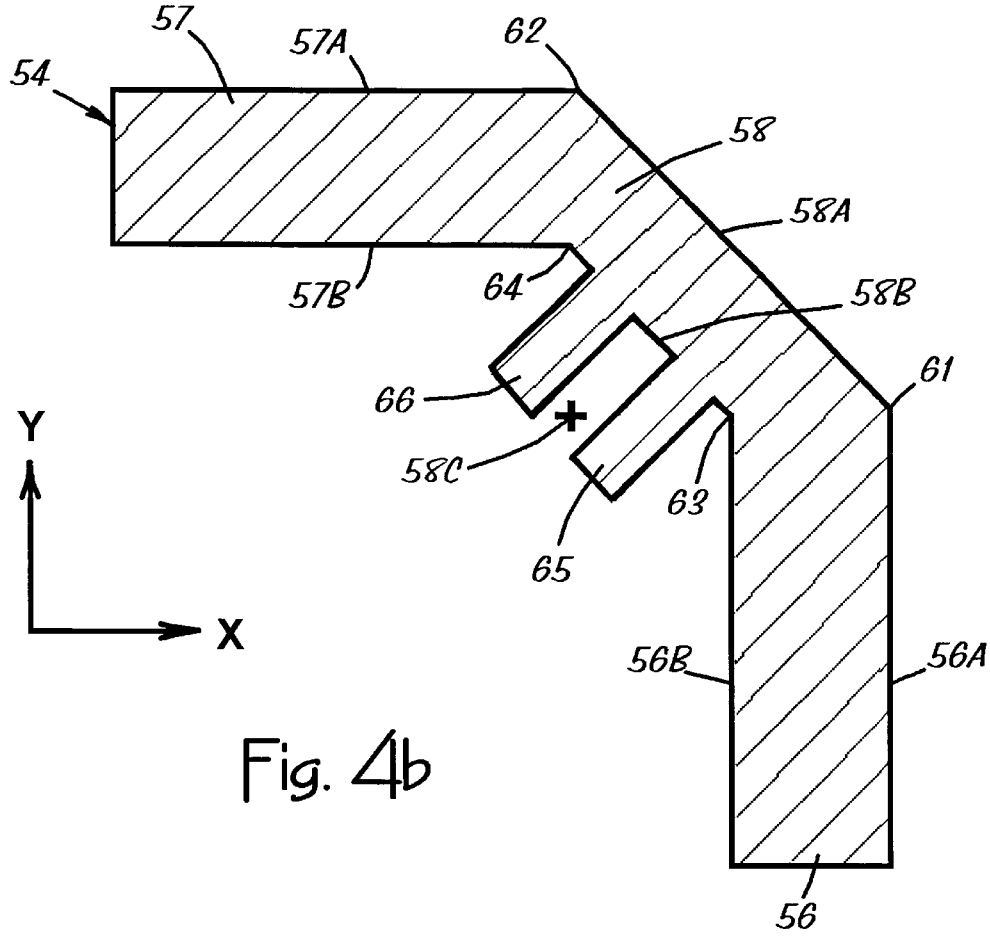
FIG. 4*b* is a plan view of just the conductive pattern of the current-phase-adjusted, mitered, right angle transmission line bend in FIG. 4*a* (not to scale)
Figure 4C:
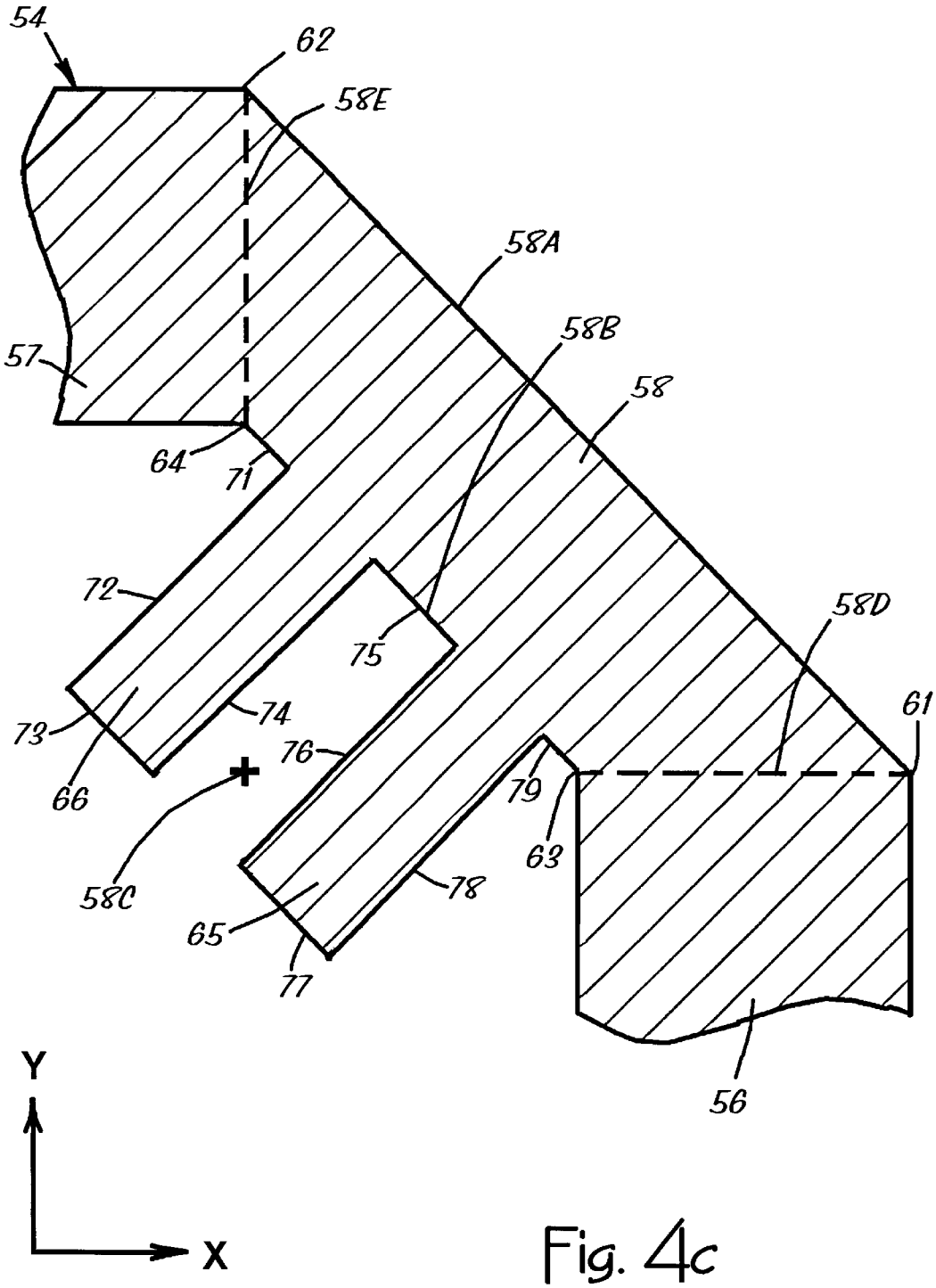
FIG. 4*c* is an enlarged plan view of just a portion of the conductive pattern in FIG. 4*b* (not to scale)

With the foregoing shortcomings of the prior art in mind, consider a preferred embodiment of the invention with reference to a mitered bend structure 50 shown in FIGS. 4*a*, 4*b*, and 4*c*, using nomenclature similar to that for the prior art bend structure 10 in FIGS. 1*a* and 1*b*. The bend structure 50 includes a dielectric substrate 51 (FIG. 4*a*), an electrically conductive first pattern 52 on a first side 53 of the substrate 51 that forms a ground plane (FIG. 4*a*), and an electrically conductive second pattern 54 on a second side 55 of the substrate 51 that forms a transmission line strip or microstrip (FIGS. 4*a*, 4*b*, and 4*c*). Together, those elements form a microstrip transmission line constructed according to the invention, and the principles and inventive concepts involved apply to other forms of transmission lines, including strip line, coplanar waveguide, balanced line, and so forth.

The second pattern 54 includes a first section 56 with outer and inner edges 56A and 56B, a second section 57 with outer and inner edges 57A and 57B, and a third section 58 between the first and second sections 56 and 57 with outer and inner edges 58A and 58B. The first section 56 extends in the Y direction of the X-Y-Z Cartesian coordinate system identified in FIGS. 4*a* and 4*b*, and the second section 57 extends in the negative X direction. The third section 58 extends between the first and second sections 56 and 57 to form a right angle bend. Dashed lines 58D and 58E in FIG. 4*c* (imaginary lines) extending perpendicular to respective ones of the Y and X axes (i.e., the first and second bend directions) serve to identify the extent of the of the third section 58. The dashed line 58D may be thought of as representing a first port 1 of the third section 58, while the dashed line 58E represents a second port 2. The first, second, and third sections 56, 57, and 58 of the second pattern 54 provide a signal path, while the first pattern 52 (the ground plane) provides a return path. Current flows through the first section 56 in the Y direction to the third section 58 were it turns into the negative X direction and continues in the second section 57, while the return current flows in the return path provided by the first pattern 52 (the ground plane) in the opposite direction.

The outer edge 58A of the third section 58 (disposed outwardly away from the direction of the bend) forms a forty-five degree outer miter between the first and second sections 56 and 57. It extends between vertexes referred to herein as first and second outer edge end points 61 and 62 (FIGS. 4*b* and 4*c*). The inner edge 58B of the third section 58 (disposed inwardly toward the direction of the bend) forms a forty-five degree miter between the first and second sections 56 and 57. It extends between two vertexes referred to herein as first and second inner edge end points 63 and 64 (FIGS. 4*b* and 4*c*). So configured, the third section 58 bends to the left around a reference point 58C, with the inner edge 58B disposed inwardly toward the reference point 58C and the outer edge disposed outwardly away from the reference point 58C.

According to a major aspect of the invention, the inner edge 58B is segmented into more than two, non-aligned, segments 71–79 (FIG. 4*c*) so that the inner edge 58B has a length at least as great as the length of the outer edge 58A. In other words, the inner edge 58B is segmented so that it extends along a circuitous path between the first and second inner edge end points 63 and 64 such that its length is at least as great as the length of the outer edge 58A. The longer inner edge 58B reduces transmission line loss. The illustrated segments 71–79 are straight line segments that intersect at right angles to form first and second inwardly protruding fingers 65 and 66. Rounded intersections and curved line segments may be used instead without departing from the inventive concepts disclosed.

The bend 50 reduces radiation loss and thereby insertion loss using a longer inner edge. The improvement in transmission line characteristics can be explained with reference to current paths along the outer and inner edges 58A and 58B. The circuitous and therefore lengthened inner edge 58B, and the longer current path it provides, help balance the phase relationship between current flowing along the inner edge 58B with current flowing along the outer edge 58A, to help balance the fringing field. This also reduces the ground current spreading to further reduce overall radiation. Moreover, the finger design gives the flexibility of adjusting the dimensions of the fingers 65 and 66 for improved return loss.

During the design of the transmission line bend structure 50, the designer empirically determines the dimensions of the segments 71–79, and thereby the dimensions of the fingers 65 and 66 and the length of the inner edge 58B, by simulating a preliminary design and then adjusting dimensions according to the simulation in order to further reduce transmission line loss. Preferably, this is done by simulating the design on a computer using EM simulation software such as the SONNET software and the MOMENTUM software described above. Based upon the foregoing description, one of ordinary skill in the art can readily implement the invention. Recapitulating the methodology employed, a method of designing a transmission line bend structure according to the invention includes the step of providing a preliminary bend structure design having an electrically conductive pattern that includes a strip with at least one inner edge extending along a circuitous path between first and second inner edge end points on the strip. The method proceeds by producing a computer simulation of the preliminary bend structure design that provides simulation information indicative of transmission line loss characteristics of the preliminary bend structure design, and adjusting the circuitous path according to the simulation information to produce an improved bend structure design with reduced transmission line loss.

In the preferred embodiment in FIGS. 4*a*, 4*b*, and 4*c*, the de-embedding on the transmission line is done up to the dashed line 58D between first outer edge end point 61 and first inner edge end point 62, and up to the dashed line 58E between the second outer edge end point 62 and the second inner edge end point 64. The same de-embedding length is used for the miter structure of FIG. 1*c*, which serves for comparing the improvement in loss. This extended de-embedding for the bend structure 50 in FIGS. 4*a*, 4*b*, and 4*c* produces more loss due to the transmission line than exact for de-embedding for the bend structure 10 in FIGS. 1*a* and 1*b*. For this reason, one can notice the difference in miter insertion loss in FIG. 5 from the one in FIG. 2. In comparison with the miter structure 20 in FIG. 1*c*, the two-fin bend structure 40 has a longer outer edge 58A. The first and second fins 65 and 66 are parallel to each other and extend diagonally away from the outer edge 58A.

The following examples of the two-finger bend structure 50 have been designed for RO3003 and glass substrate materials. However, they can be designed for other substrate materials, including Duroid, a proprietary product of Rogers Corporation consisting of woven glass/PTFE laminates. All microstrip transmission line impedances in the examples are 50 Ohm. For the RO3003 dielectric, the designs are done for three different substrate thicknesses (i.e., the Z dimension of the substrate), depending on the frequency of use, and glass is analyzed for one substrate thickness.

For a 127-micron thick RO3003 substrate, the microstrip line width (i.e., the X dimension of the first section 56 and the Y dimension of the second section 57) is 308 microns. That results in a nominal 50-Ohm impedance. The bend line width (i.e., the perpendicular distance between the outer edge 58A and the first inner edge end point 63) is 218 microns. The length of the outer edge 58A (i.e., the distance between the first and second outer edge end points 61 and 62) is 871 microns. The lengths of the fingers 65 and 66 (i.e., the length of the segments 72, 74, 76, and 78) are 271 microns. The distance between fingers (i.e., the length of segment 75) is 109 microns, and the fingers are centered between the vertexes 63 and 64 so that the segments 71 and 79 are equal.

For a 127-micron thick glass substrate, the microstrip line width is 127 microns for 50-Ohm impedance. The bend line width is 187 microns. The length of the outer edge 58A is 747 microns. The lengths of the fingers 65 and 66 are 233 microns. The width of each of the fingers 65 and 66 and the distance between fingers are 93 microns.

For a 254-micron thick RO3003 substrate, the microstrip line width is 704 microns. The bend line width is 498 microns. The length of the outer edge 58A is 1191 microns. The lengths of the fingers 65 and 66 are 498 microns. The width of each of the fingers 65 and 66 and the distance between fingers are 249 microns.

For a 635-micron thick RO3003 substrate, the microstrip line width is 1840 microns. The bend line width is 1301 microns. The length of the outer edge 58A is 5204 microns. The lengths of the fingers 65 and 66 are 1301 microns. The width of each of the fingers 65 and 66 and the distance between fingers are 650 microns.

Figure 5A:
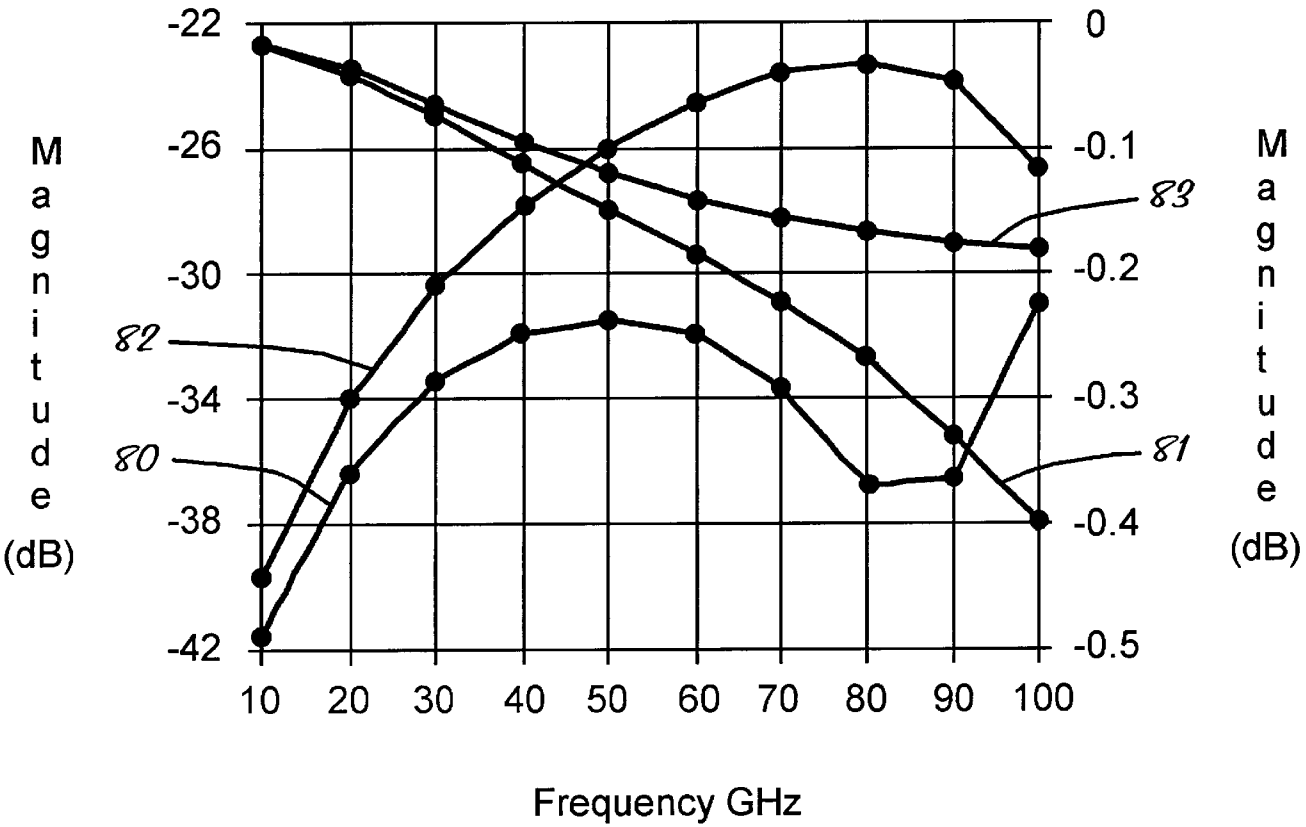
FIG. 5*a* shows the simulated performance of the current-phase-adjusted, mitered, right angle transmission line bend in FIGS. 4*a*, 4*b*, and 4*c* in comparison with a prior art mitered right angle bend.

Improvements in insertion loss for the 127-micron thick RO3003 substrate at 80 GHz are more than 35%, as shown in FIG. 5*a*. The plots 80 and 81 are, respectively, the return loss and the insertion loss for the prior art miter bend structure 20 in FIG. 1*c*. The plots 82 and 83 are, respectively, the return loss and the insertion loss for the current-phase-compensated bend structure 50 in FIGS. 4*a*, 4*b*, and 4*c*. The scale on the left applies to the return loss plots 80 and 82, while the scale on the right applies to the insertion loss plots 81 and 83.

Figure 5B:
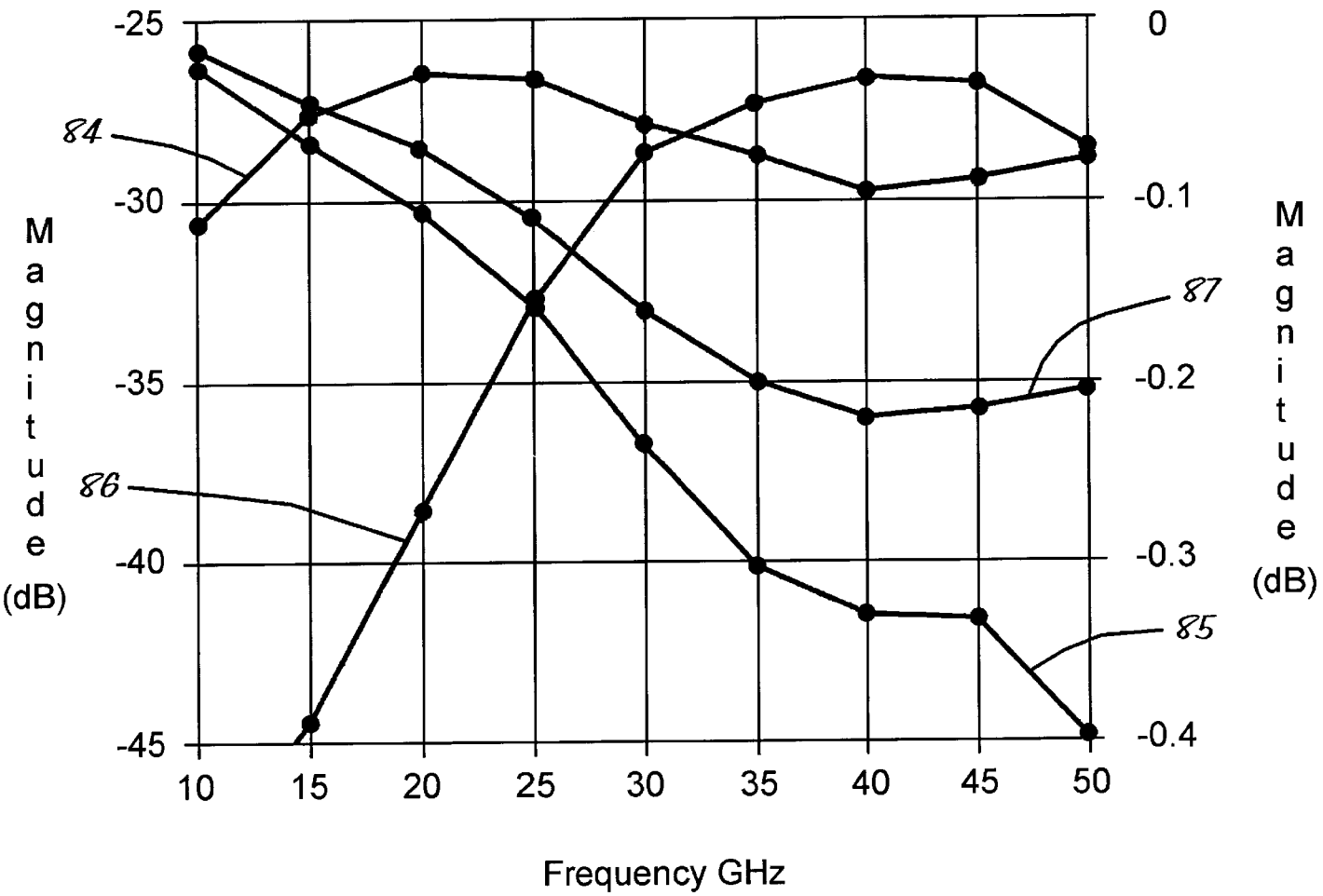
FIG. 5*b* shows the simulated performance of the current-phase-adjusted, mitered, right angle transmission line bend in FIGS. 4*a*, 4*b*, and 4*c* in comparison with a prior art mitered right angle bend for a substrate height of 254 microns and a 50-ohm microstrip line.

Improvements in insertion loss for the 254-micron thick RO3003 substrate at 40 GHz are more than 35%, as shown in FIG. 5*b*. The plots 84 and 85 are, respectively, the return loss and the insertion loss for the prior art miter bend structure 20 in FIG. 1*c*. The plots 86 and 87 are, respectively, the return loss and the insertion loss for the current-phase-compensated bend structure 50 in FIGS. 4*a*, 4*b*, and 4*c*. The scale on the left applies to the return loss plots 84 and 86, while the scale on the right applies to the insertion loss plots 85 and 87.

Figure 5C:
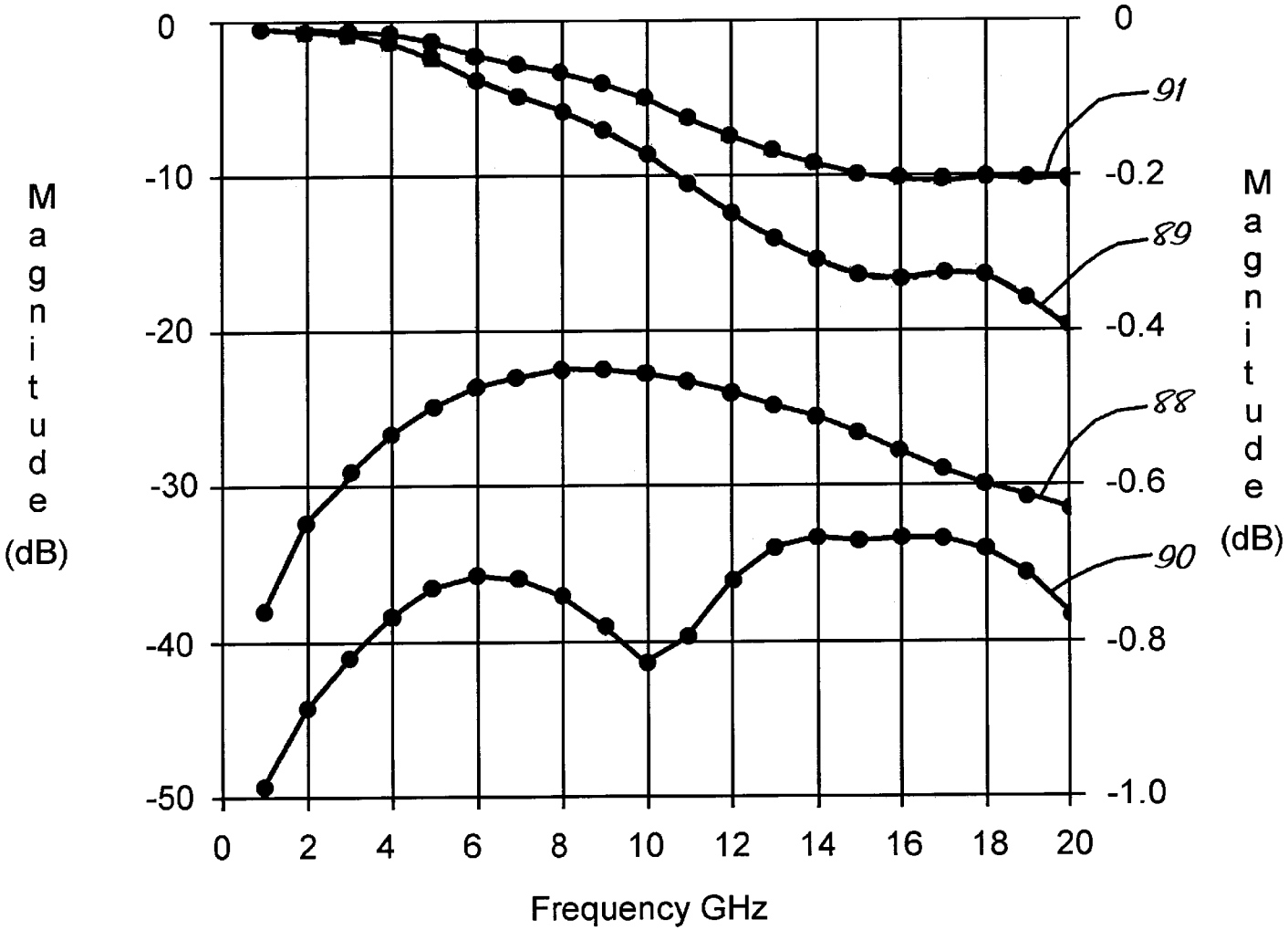
FIG. 5*c* shows the simulated performance of the current-phase-adjusted, mitered, right angle transmission line bend in FIGS. 4*a*, 4*b*, and 4*c* in comparison with a prior art mitered right angle bend for a substrate height of 625 microns and a 50-ohm microstrip line.

Improvements in insertion loss for the 635-micron thick RO3003 substrate at 20 GHz are more than 45%, as shown in FIG. 5*c*. The plots 88 and 89 are, respectively, the return loss $S_{11}$ and the insertion loss $S_{21}$ for the prior art miter bend structure 20 in FIG. 1*c*. The plots 90 and 91 are, respectively, the return loss $S_{11}$ and the insertion loss $S_{21}$ for the current-phase-compensated bend structure 50 in FIGS. 4*a*, 4*b*, and 4*c*. The scale on the left applies to the return loss plots 88 and 90, while the scale on the right applies to the insertion loss plots 89 and 91.

Figure 6A:
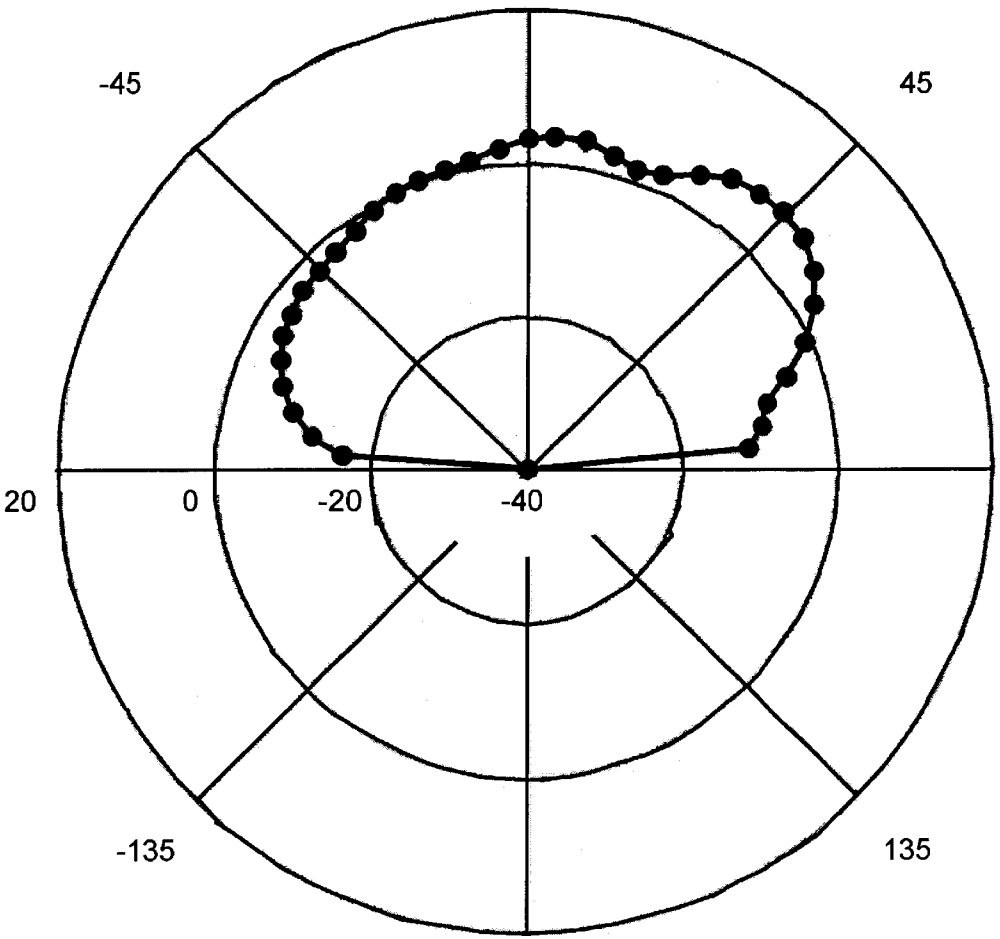
FIG. 6*a* shows the radiated pattern for the prior art, mitered, right angle transmission line bend in FIG. 1*c* at $\phi=0$ and $\theta$ plotted from −90 degrees to +90 degrees.
Figure 6B:
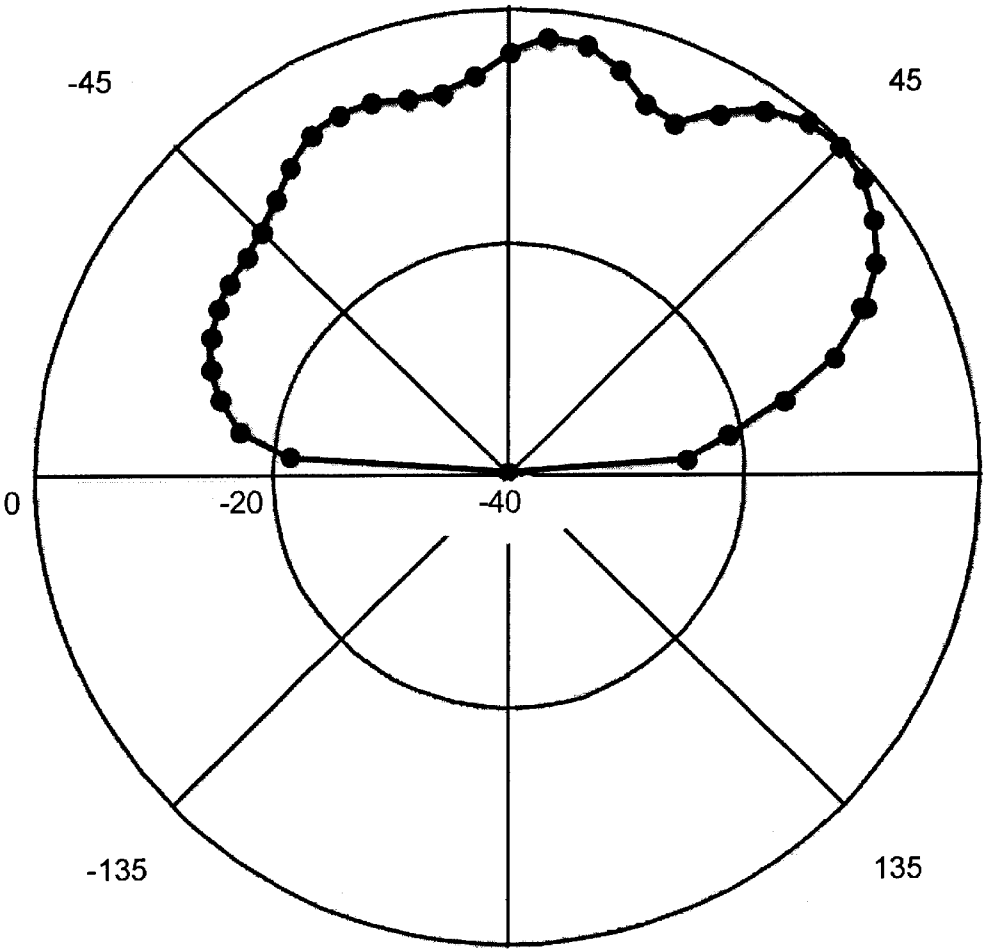
FIG. 6*b* shows the radiated pattern for the phase-adjusted mitered, right angle transmission line bend in FIGS. 4*a*, 4*b* and 4*c* at $\phi=0$ and $\theta$ plotted from −90 degrees to +90 degrees.

FIG. 6*a* is a polar plot of radiated power versus antenna gain for the prior art mitered bend structure 20 in FIG. 1*c*, while FIG. 6*a* is a polar plot of radiated power versus antenna gain for the current-phase-compensated bend structure 50 in FIGS. 4*a*, 4*b*, and 4*c*. There is about 8 dB difference in gain for $\theta=0$ degrees, indicating substantially reduced radiation. In all the above examples, line lengths are approximately the same. In any case, losses due to the line are much less than losses due to the bend structures.

At 80 GHz, the radiated power from the mitered bend structure 20 is about 4.47%. For the current-phase-compensated bend structure 50 with the first and second fingers 65 and 66, the radiated power is 2.09%. That equals an improvement of over 50% in radiated power and this directly affects antenna patterns for a patch array. The other examples also prove very effective in reducing the power loss. While the results are presented above are only for RO3003 substrate material, the bend structure on a glass substrate displays quantitatively similar characteristics. At 80 GHz, the improvement in the loss for the 127-micron thick glass substrate was over 40%.

Figure 7:
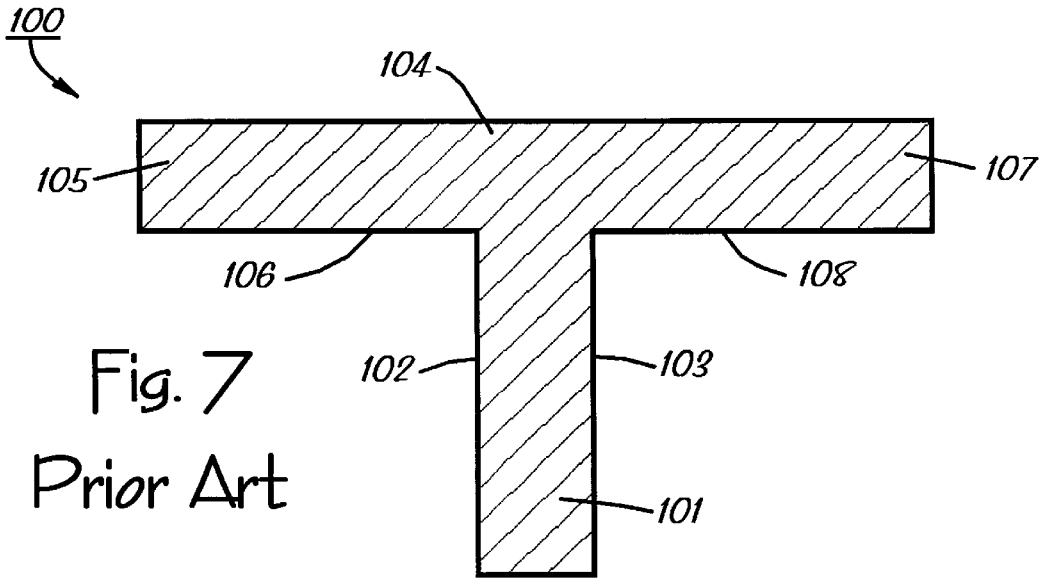
Fig. 7 Prior Art
FIG. 7 is a plan view of a typical prior art T-structure used in antenna arrays.

Now consider FIG. 7. It shows the electrically conductive pattern of a transmission line bend structure 100 constructed according to the prior art in the form of a typical T-type junction. A first section 101 with first and second inner edges 102 and 103 joins a section 104 having a first leg 105 with an inner edge 106 extending to the left in a first direction and a second leg 107 with an inner edge 108 extending to the right in an opposite second direction.

Figure 8:
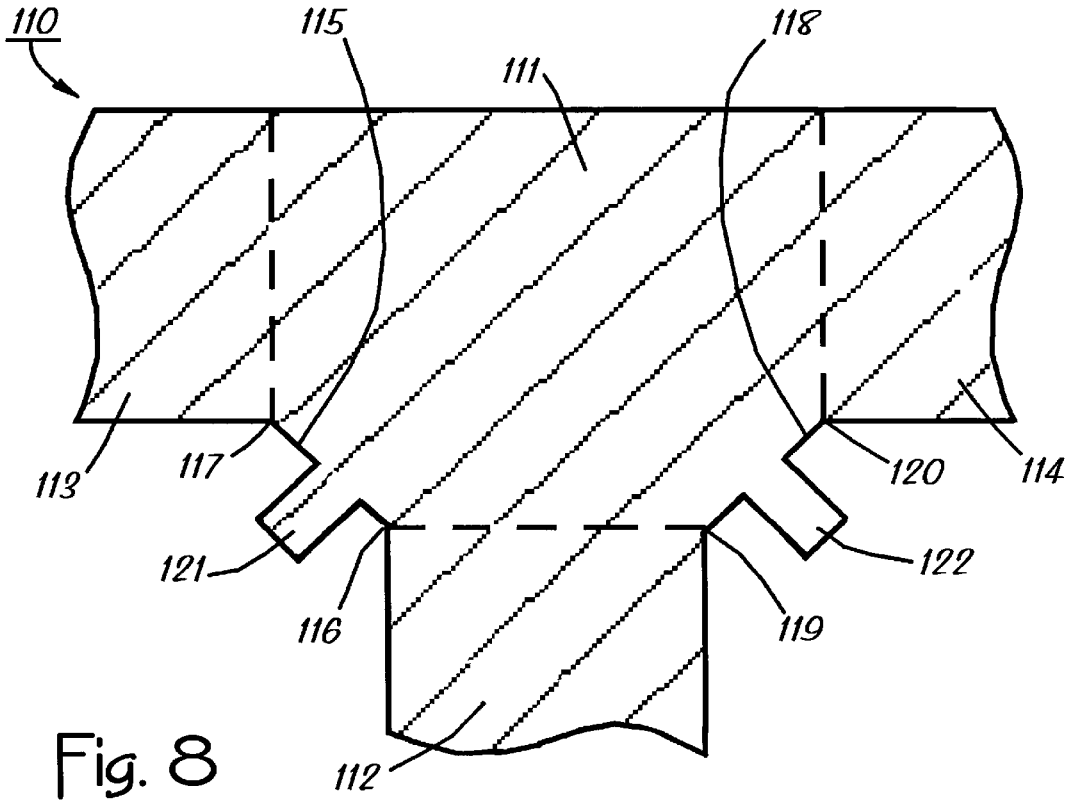
FIG. 8 is an enlarged plan view of a portion of a current-phase-adjusted T-structure having two finger structures (not to scale)

FIG. 8 shows an electrically conductive pattern of a transmission line bend structure 110 in the form of a current-phase-compensated T-type junction that is similar in some respects to the bend structure 100 in FIG. 7. A bend pattern portion 111 of the bend structure 110 couples power from a first leg 112 to oppositely directed legs 113 and 114 (two right angle bends). A first inner edge 115 extends toward the left between first and second inner edge end points 116 and 117 of the first inner edge 115, while a second inner edge 118 extends toward the right between first and second inner edge end points 119 and 120 of the second inner edge 118.

Figure 9:
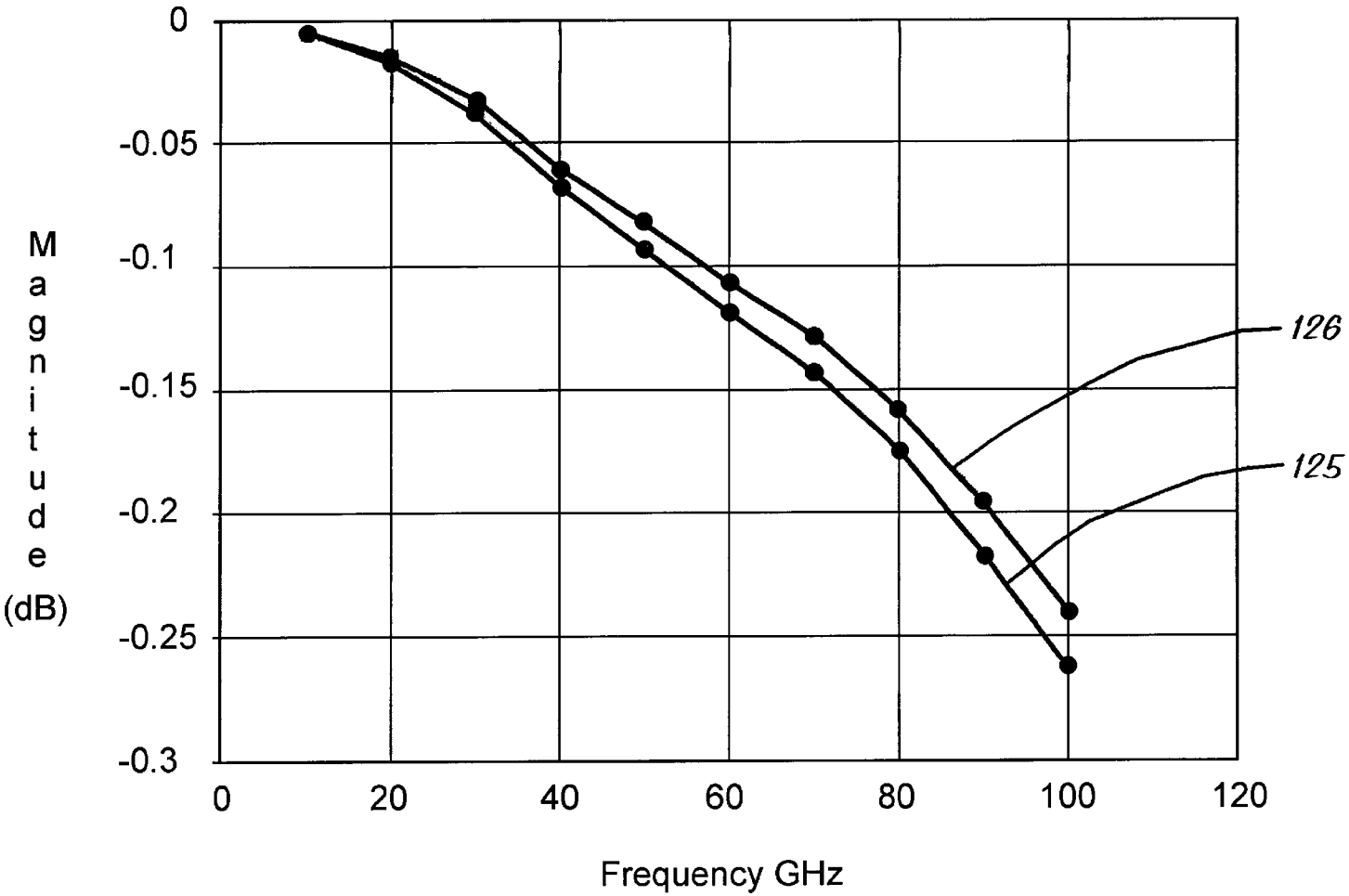
FIG. 9 are two plots that compare the loss of the T-structures in FIGS. 7 and 8.

The first inner edge 115 is segmented into five non-aligned segments so that it extends along a circuitous path (forming a first finger 121), while the second inner edge 118 is segmented into another five non-aligned segments so that it also extends along a circuitous path (forming a second finger 122). The lengths added to the first and second inner edges 115 and 118 by the fingers 121 and 122 help reduce transmission line loss in the manner described for the bend structure 50 in FIGS. 4*a*, 4*b*, and 4*c*. In designing the bend structure 110, the designer simulates the bend structure 110 with EM simulation software and adjusts the dimensions of the first and second fingers 121 and 122 to at least partially optimize the design for reduced transmission line loss. FIG. 9 compares a plot 125 of the insertion loss for the structure 100 in FIG. 7 with a plot 126 of the insertion loss for the structure 110 in FIG. 8. From the foregoing description, one of ordinary skill in the art can readily implement the invention in the form of a T-type junction using any of various shapes and sizes for the inner edges.

Figure 10A:
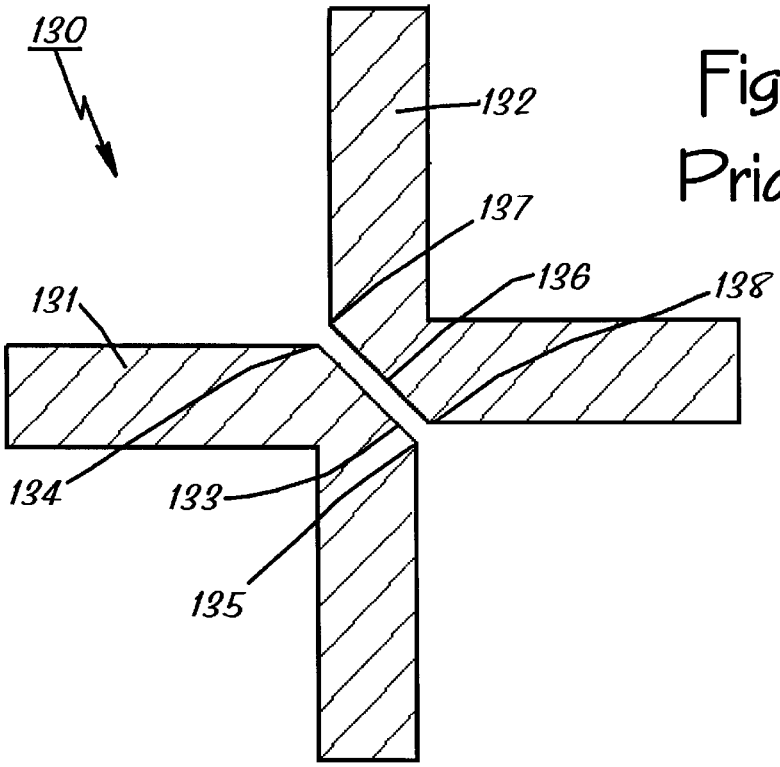
Fig. 10a Prior Art
FIG. 10*a* is a plan view of two prior art coupled bends utilizing mitered, right angle bends spaced apart 871 micrometers (not to scale)

In FIG. 10*a*, a prior art coupling structure 130 is shown that includes two miter structures 131 and 132. An outer edge 133 of the structure 131 extends between first and second end points 134 and 135 of the outer edge 133, while an outer edge 136 of the structure 132 extends between first and second end points 137 and 138 of the structure 132. The outer edges 133 and 136 are spaced apart 871 microns.

Figure 10B:
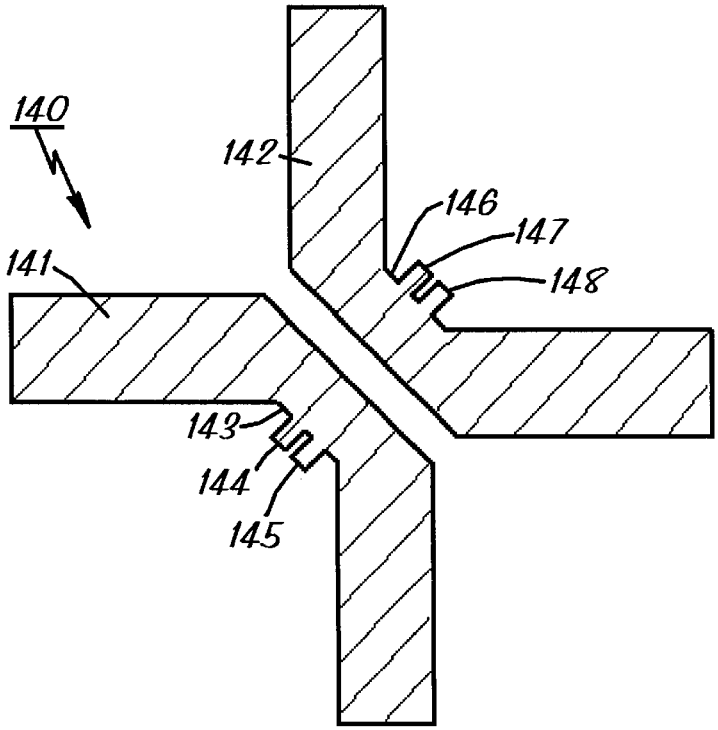
FIG. 10*b* is a plan view of two coupled bends utilizing current-phase-adjusted, mitered, right angle bends spaced apart 871 micrometers (not to scale)

FIG. 10*b* shows a similar coupling structure 140 having two current-phase-compensated component structures 141 and 142 constructed according to the invention. They are spaced apart the same as the prior art bend in FIG. 10*a*. An inner edge 143 of the structure 141 extends along a circuitous path forming two fingers 144 and 145, while an inner edge 146 extends along a circuitous path forming two fingers 147 and 148.

Figure 11:
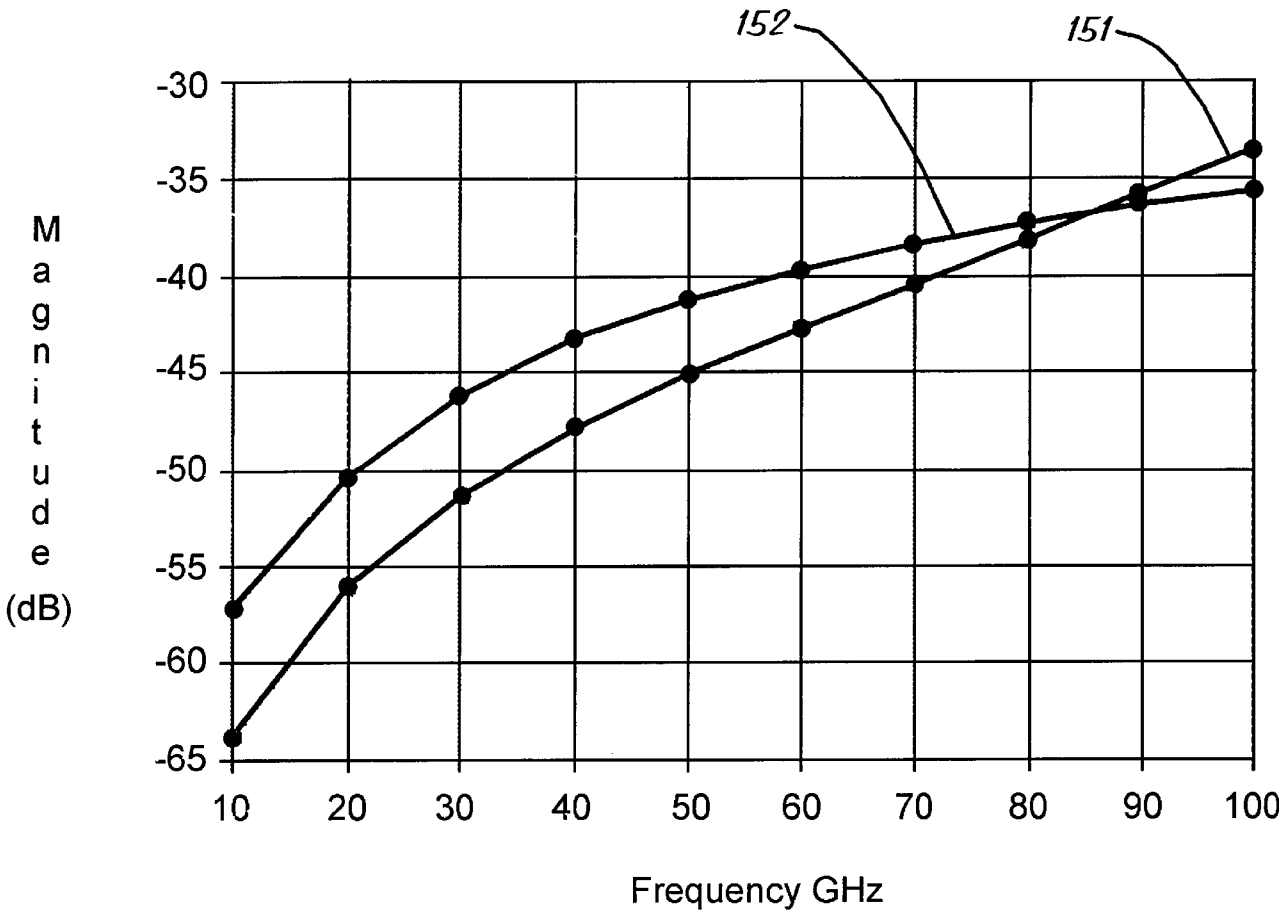
FIG. 11 are plots comparing the isolation between the coupled bends in FIGS. 10*a* and 10*b;*

FIG. 11 shows the characteristics of the two coupling structures 130 and 140. The plot 151 is for the coupling structure 130 and the plot 152 is for the coupling structure 140, showing isolation of more than 35 dB at 80 GHz. The isolation between the structures 130 and 140 is governed primarily by the parallel sections. As a result, the novel bend having a longer parallel section couples more.

Figure 12A:
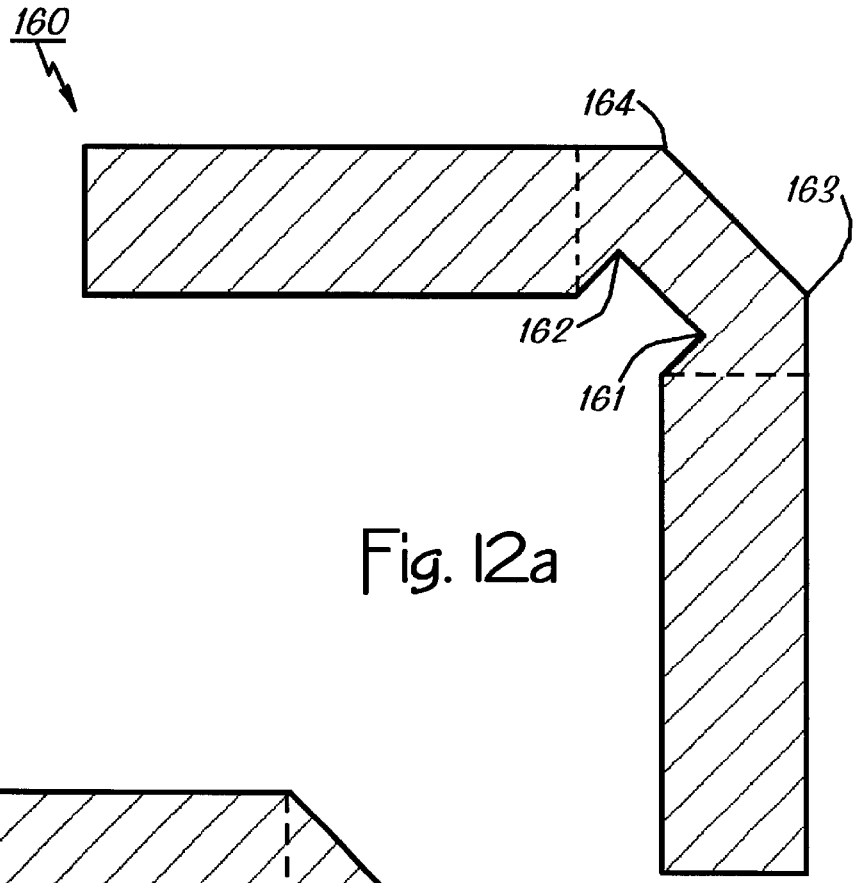
FIGS. 12*a*–12*f* are plan views of the conductive pattern of six alternative embodiments of the invention having transmission line bends with current-phase-adjustment (not to scale).
Figure 12B:
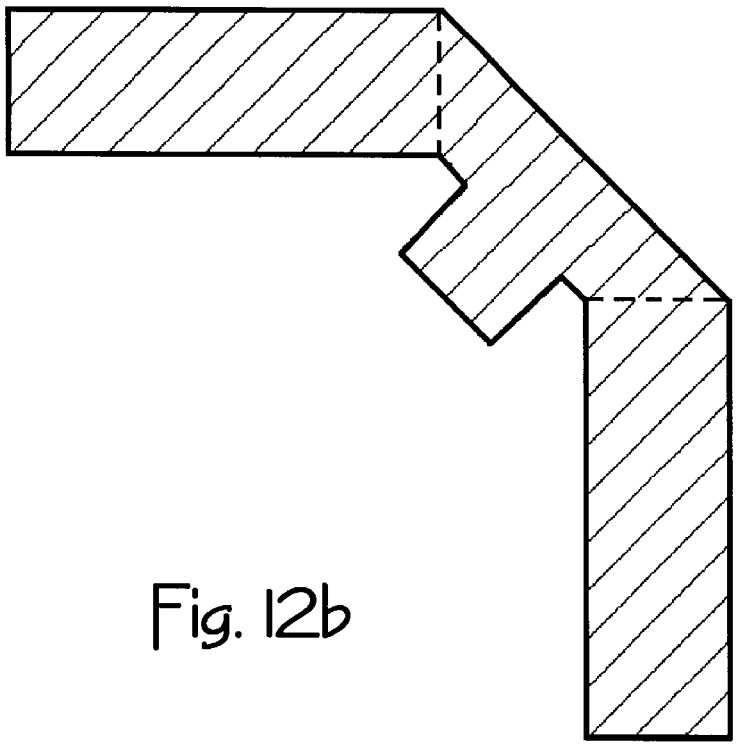
Figure 12C:
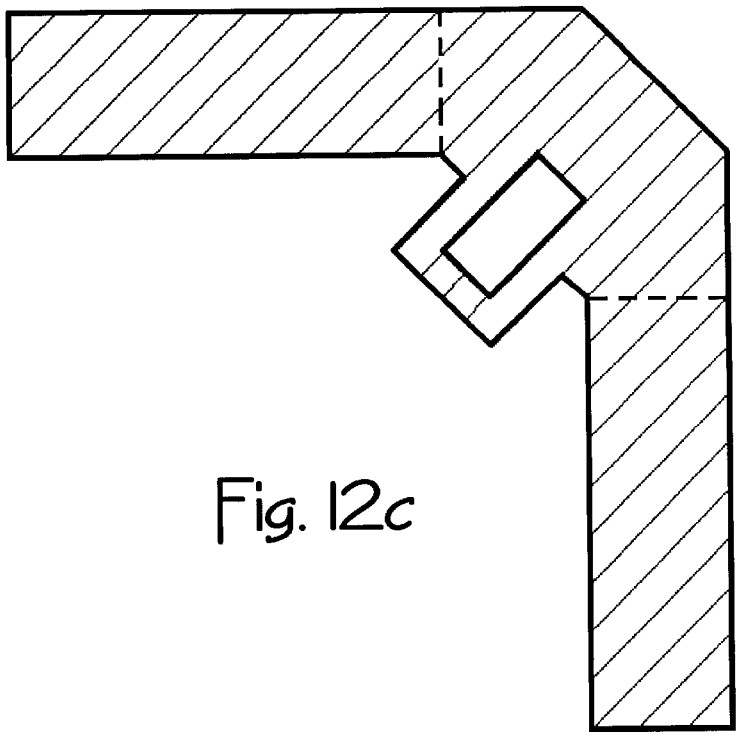
Figure 12D:
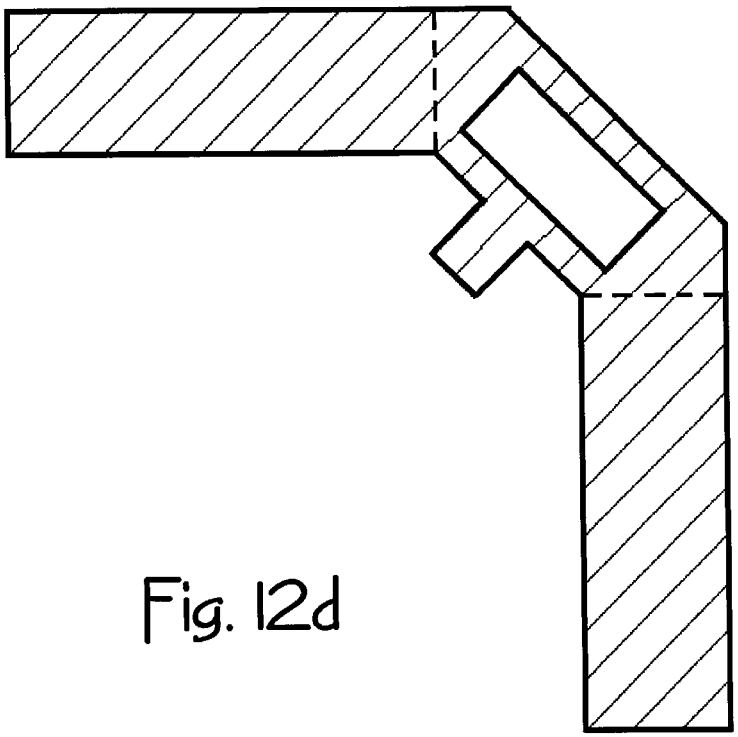
Figure 12E:
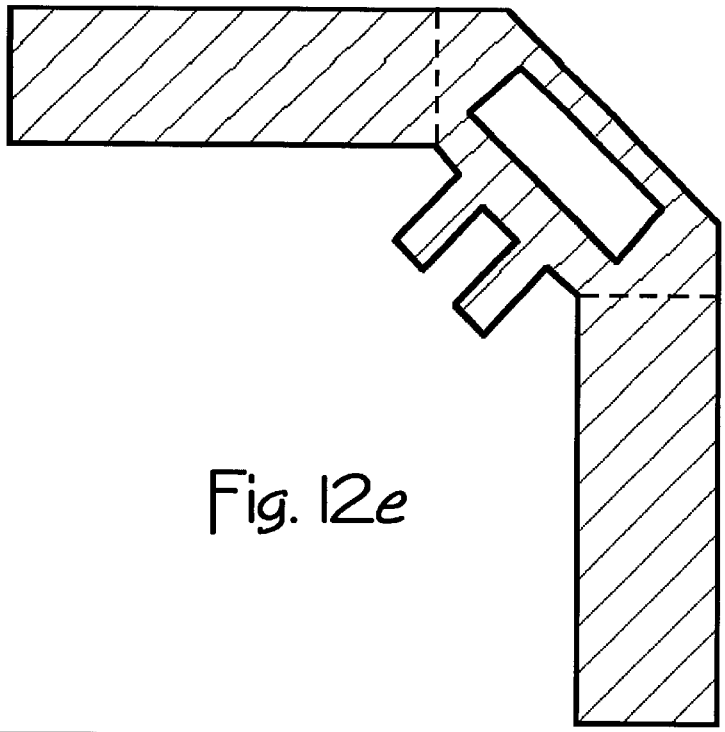
Figure 12F:
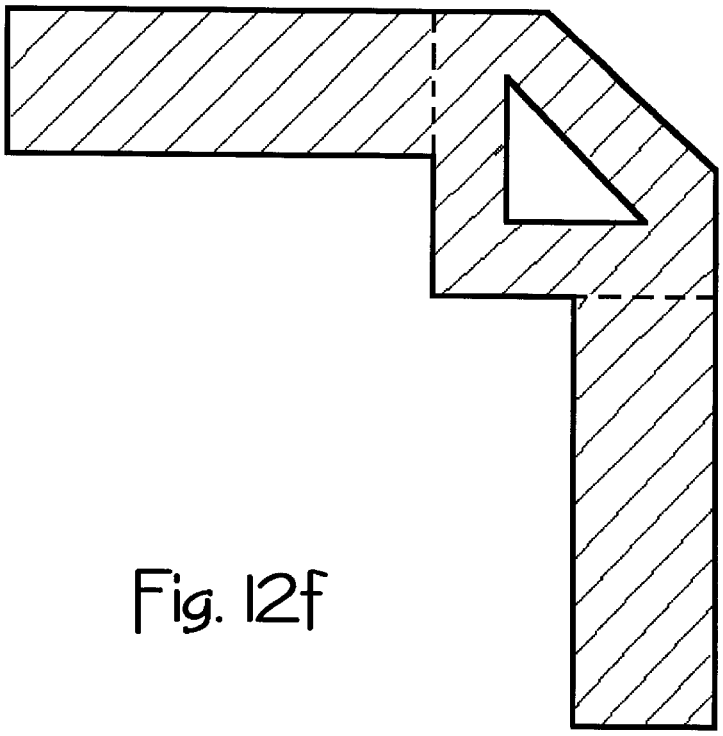

FIGS. 12*a*–12*f* show other geometries that fall within some of the broader inventive concepts disclosed. For the structure 160 in FIG. 12*a*, vertexes 161 and 162 are close to vertexes 163 and 164. That arrangement reduces transmission line width in the corner. FIG. 12*b* shows a one-finger structure. FIG. 12*c* shows a one-finger structure with an opening or slot inserted partially inside the finger in order to reduce the capacitance and obtain better return loss characteristics. FIG. 12*d* shows a one-finger structure with an opening or slot inserted outside and perpendicular to the finger in order to obtain better return loss characteristics. FIG. 12*e* shows a two-finger structure with an opening or slot inserted outside and perpendicular to the finger in order to obtain better return loss characteristics. FIG. 12*f* shows a structure with the right angle corner in between two perpendicular inner edges of the bend. The triangular opening or slot is in the middle of the bend, having all of its edges parallel to the edges of the bend. The triangular opening or slot reduces the capacitance in order to obtain better return loss characteristics.

Thus, the invention provides a design method and transmission line bend structure for reducing transmission line loss that lengthens the inner edge of a strip. That lengthens the current paths along the inner edge for a significant reduction in transmission line loss. The bend structure reduces fringing fields and ground plane current spreading and it balances or cancels radiation created due to the bend discontinuity. Although a exemplary embodiments have been shown and described, one of ordinary skill in the art may make many changes, modifications, and substitutions without necessarily departing from the spirit and scope of the invention. The circuitous path resulting from the plurality of segments, for example, may include curved and/or straight line segments and it is intended that curved and/or straight line segments fall within the scope of the claims.

What is claimed is:

1. A transmission line bend structure, comprising:

a substrate and an electrically conductive pattern on the substrate that forms a transmission line;

wherein the electrically conductive pattern includes at least one strip that forms a bend from a first direction to a second direction different from the first direction;

wherein the bend formed by said strip includes at least one inner edge, which inner edge has a first length and extends between first and second inner edge end points on the strip;

wherein the bend formed by said strip includes at least one outer edge disposed opposite the inner edge, which outer edge has a second length and extends between first and second outer edge end points on the strip; and wherein said inner edge includes a plurality of segments so that the inner edge extends along a circuitous path in order to thereby reduce transmission line loss.

2. A transmission line bend structure as recited in claim 1, wherein the inner edge forms at least one outwardly protruding finger that contributes to the circuitous path.

3. A transmission line bend structure as recited in claim 1, wherein the inner edge forms at least two outwardly protruding fingers that contribute to the circuitous path.

4. A transmission line bend structure as recited in claim 1, wherein the inner edge forms at least one inwardly extending recess that contributes to the circuitous path.

5. A transmission line bend structure as recited in claim 1, wherein the strip forms a right angle bend.

6. A transmission line bend structure as recited in claim 1, wherein the outer edge is a single straight line segment.

7. A transmission line bend structure as recited in claim 1, wherein the strip defines an opening that reduces capacitance to equalize current paths and thereby reduce return loss.

8. A transmission line bend structure as recited in claim 7, wherein the opening is rectangularly shaped.

9. A transmission line bend structure as recited in claim 7, wherein the opening is triangularly shaped.

10. A transmission line bend structure, comprising:

a substrate and an electrically conductive pattern on the substrate that forms a transmission line such that the transmission line includes at least one strip that forms a T-type junction;

wherein the T-type junction formed by said strip includes oppositely disposed first and second inner edges, the first inner edge extending between first and second end points of the first inner edge, and the second inner edge extending between first and second end points of the second inner edge;

wherein the first inner edge includes a first plurality of segments that result in the first inner edge extending along a circuitous path between the first and second end points of the first inner edge; and wherein the second inner edge includes a second plurality of segments that result in the second inner edge extending along a circuitous path between the first and second end points of the second inner edge;

thereby to increase current path lengths along the first and second inner edges in order to help reduce transmission line loss.

11. A transmission line bend structure as recited in claim 10, wherein each of the inner edges forms at least one outwardly protruding finger that contributes to the circuitous path.

12. A method of designing a transmission line bend structure, comprising:

providing a preliminary bend structure design having an electrically conductive pattern that includes a strip with at least one inner edge extending along a circuitous path between first and second inner edge end points on the strip;

producing simulation information indicative of transmission line loss characteristics of the preliminary bend structure design; and adjusting the circuitous path according to the simulation information to produce an improved bend structure design with reduced transmission line loss.

* * * * *